US008746103B2

(12) United States Patent
Apkarian et al.

(10) Patent No.: US 8,746,103 B2
(45) Date of Patent: Jun. 10, 2014

(54) MECHANICAL LINKAGE

(75) Inventors: Jacob Apkarian, Toronto (CA); Ryan Leslie, Belwood (CA)

(73) Assignee: Quanser Consulting Inc., Markham (CA)

( * ) Notice: Subject to any disclaimer, the term of this patent is extended or adjusted under 35 U.S.C. 154(b) by 1058 days.

(21) Appl. No.: 12/145,543

(22) Filed: Jun. 25, 2008

(65) Prior Publication Data

US 2008/0314182 A1 Dec. 25, 2008

Related U.S. Application Data

(60) Provisional application No. 60/946,034, filed on Jun. 25, 2007.

(51) Int. Cl.
*G05G 1/00* (2008.04)

(52) U.S. Cl.
USPC ..... 74/471 XY

(58) Field of Classification Search
USPC ..... 74/469, 471 XY, 473.3, 473.33, 491
See application file for complete search history.

(56) References Cited

U.S. PATENT DOCUMENTS

| | | | | |
|---|---|---|---|---|
| 5,497,847 | A * | 3/1996 | Ota et al. | 180/333 |
| 5,816,105 | A * | 10/1998 | Adelstein | 74/471 XY |
| 6,486,872 | B2 * | 11/2002 | Rosenberg et al. | 345/161 |
| 2003/0126938 | A1 * | 7/2003 | Nordstrom | 74/471 XY |
| 2004/0164959 | A1 * | 8/2004 | Rosenberg et al. | 345/161 |
| 2004/0183777 | A1 * | 9/2004 | Bevirt et al. | 345/156 |

FOREIGN PATENT DOCUMENTS

JP 60223539 A * 11/1985 ..... E02F 9/20

* cited by examiner

*Primary Examiner* — Vicky Johnson
(74) *Attorney, Agent, or Firm* — Bereskin & Parr LLP/S.E.N.C.R.L., s.r.l.

(57) ABSTRACT

This invention relates to mechanical linkages. The claimed linkages have a plurality of members that rotationally couple an extension member to a ground member. The linkages have relatively less inefficiency caused by inertia and from the placement of transducers within the linkage. Various coupling in the linkages may be powered, providing mechanical linkages that are suitable for use in haptic systems.

21 Claims, 17 Drawing Sheets

MECHANICAL LINKAGE

This is an application claiming the benefit under 35 USC 119(e) of U.S. Provisional Patent Application Ser. No. 60/946,034 filed Jun. 25, 2007. U.S. Ser. No. 60/946,034 is incorporated herein, in its entirety, by this reference to it.

FIELD

The embodiments described herein relate to mechanical linkages.

BACKGROUND

Mechanical linkages are used in various devices to couple a tool to a grounded element. For example, in some haptic systems the tool is a device that is manipulated by a user. The haptic system may be part of a model of a real or virtual environment. In haptic and other systems that incorporate a mechanical linkage, it is desirable that the system be capable of modeling the physical behavior of the simulated environment. For example, the linkage provides monitoring or control (or both) of some or all of the degrees of freedom of the simulated environment.

Existing linkages include various deficiencies including inertia resulting from coupling of various components of the linkage, the positioning of transducers within the linkage which may provide undesirable inefficiencies in the linkage that limit the effectiveness of the linkage in modeling the simulated environment.

Accordingly, there is a need for an improved mechanical linkage for use in modeling and other systems.

SUMMARY

In one aspect, some embodiments of the invention provide a six member linkage comprising:

a ground member;

a first connecting member rotationally coupled to the ground member with a first grounded coupling;

a second connecting member rotationally coupled to the ground member with a second grounded coupling;

an extension member;

a mount adapted for receiving the extension member, wherein the extension member can translate along a translation axis;

a first link member for rotationally coupling the first connecting member to the mount; and a second link member for rotationally coupling the second connecting member to the mount, wherein the first link member is coupled to the extension member such that the first link member rotates in response to a translation of the extension member.

In some embodiments, the first link member is powered and the extension member moves along the translation axis in response to a rotation of the first link member.

In some embodiments, the first link member and the extension member are coupled with a linkage selected from the group consisting of:

a capstan transmission;

a rack and pinion mechanism; and a friction drive.

In some embodiments, the second link member and the mount are rotationally coupled.

In some embodiments, the second link member and the mount are coupled with a rotational coupling.

In some embodiments, the extension member passes through the rotational coupling.

In some embodiments, the rotational coupling is a bearing.

In some embodiments, the second link member and the mount are rotationally coupled with a bearing that essentially surrounds the mount.

In some embodiments, the second link member and the mount are rotationally coupled with a bearing that is at least partially nested within the mount.

In some embodiments, the second link member and the mount are coupled with a second link coupling that is offset from the mount.

In some embodiments, the second link coupling is a bearing.

In some embodiments, the second connecting member rotates about a second grounded axis and wherein the second link coupling rotates about a second link axis at an angle to the second grounded axis.

In some embodiments, the first connecting member rotates about a first grounded axis and the second link member rotates about the first grounded axis.

In some embodiments, the linkage further includes an end effector mounted to the extension member, wherein the end effector is adapted to receive a tool.

In some embodiments, the tool corresponds to a member of the group consisting of:

a laparoscopic tool;

scissors;

a flight control instrument;

a screwdriver;

a syringe;

a hypodermic needle;

a gaming input device;

a handgrip;

a joystick; and a gimbal mechanism.

In some embodiments, the extension member can rotate about the translation axis and the linkage further comprises an extension member rotation position sensor for monitoring the rotation of the extension member.

In some embodiments, the linkage further comprises an extension member rotation actuator for controlling the rotation of the extension member about the translation axis.

In some embodiments, the linkage further comprises an extension member transducer system for controlling the translational position of the extension along the translation axis.

In some embodiments, the extension member transducer system includes an extension member transducer coupled to the first link member.

In some embodiments, the extension member transducer is directly coupled to the ground member.

In some embodiments of the linkage the extension member transducer includes an output shaft and wherein the axis of rotation of the output shaft is substantially orthogonal to the axis of rotation of the first link member.

In some embodiments, the extension member transducer is coupled to the first link member through a coupling selected from the group consisting of:

a belt drive mechanism;

a cable drive mechanism;

a direct drive mechanism;

a friction drive mechanism; and a rack and pinion mechanism.

In some embodiments of the linkage the extension member transducer is positioned at least partially within the first connecting member.

Some embodiments of the invention provide a mechanical linkage comprising:

a ground member;

a first connecting member rotationally coupled to the ground member with a first grounded coupling;

a second connecting member rotationally coupled to the ground member with a second grounded coupling;

an extension member;

a mount adapted for receiving the extension member, wherein the extension member can translate along a translation axis;

a first link member for rotationally coupling the first connecting member to the mount;

a second link member for rotationally coupling the second connecting member to the mount; and an extension member transducer directly coupled to the ground member, wherein the extension member transducer is coupled to the extension member for controlling the translational position of the extension member along the translation axis.

In some embodiments, the linkage further comprises a first link member pulley rotationally coupled to the first link member with a coupling, wherein the first link member pulley is coupled to the extension member such that the first link member pulley rotates in response to a translation of the extension member.

In some embodiments of the linkage the extension member transducer is coupled to the first link member pulley.

In some embodiments the extension member transducer is coupled to the first link member pulley through a coupling selected from the group consisting of:

a belt drive mechanism; and a cable drive mechanism.

In some embodiments, the extension member transducer includes a position sensor for monitoring the translational position of the extension member and an actuator for controlling the translational position of the extension member.

In another aspect, some embodiments of the invention provide a mechanical linkage comprising:

a ground member;

a first connecting member rotationally coupled to the ground member with a first grounded coupling;

a second connecting member rotationally coupled to the ground member with a second grounded coupling;

an extension member;

a mount adapted for receiving the extension member, wherein the extension member is translationally coupled to the mount;

a first link member rotationally coupled to the first connecting member and rotationally coupled to the mount; and a second link member for rotationally coupling the second connecting member to the mount, wherein the first link member is coupled to the extension member such that the first link member rotates in response to a translation of the extension member.

In some embodiments, the second link member is rotationally coupled to the second connecting member and rotationally coupled to the mount.

In some embodiments, the extension member translates in response to a rotation of the first link member.

In some embodiments, the first connecting member rotates about a first grounded axis and the second connecting member rotates about the second grounded axis wherein the first and second grounded axes are at an angle and intersect at a gimbal point.

In some embodiments, the first link member rotates about a first link axis that is fixed to the first connecting member, wherein the first link axis is at an angle to the first grounded axis and intersects the first grounded axis at the gimbal point.

In some embodiments, the second link member rotates about a second link axis that is fixed to the second connecting member, wherein the second link axis is at an angle to the second grounded axis and intersects the second grounded axis at the gimbal point.

In some embodiments, the mount rotates about a mount axis which is fixed to the second link member wherein the mount axis is at an angle to the second link axis and intersects the second link axis at the gimbal point.

In some embodiments, the mount rotates about the first link axis.

In some embodiments, the first connecting member is powered by a first grounded transducer system mounted to the ground member.

In some embodiments, the first grounded transducer system includes components selected from the group consisting of:

an electric motor;

a capstan transmission;

a belt drive;

a rigid coupling;

a position sensor; and a brake mechanism.

In some embodiments, the second connecting member is powered by a second grounded transducer system mounted to the ground member.

In some embodiments, the second grounded transducer system includes components selected from the group consisting of:

an electric motor;

a capstan transmission;

a belt drive;

a rigid coupling;

a position sensor; and a brake mechanism.

In some embodiments, the first link member and the extension member are coupled with an extension member transmission selected from the group consisting of:

a capstan transmission;

a rack and pinion mechanism;

a friction drive; and a belt drive.

In some embodiments, the first link member is powered by a first link transducer system mounted to the first connecting member or the ground member or the mount member.

In some embodiments, the first link transducer system includes components selected from the group consisting of:

an electric motor;

a capstan transmission;

a belt drive;

a rigid coupling;

a position sensor; and a brake mechanism.

In some embodiments, the mechanical linkage further includes an end effector member coupled to the extension member.

In some embodiments, the end effector is rotationally coupled to the extension member.

In some embodiments, the end effector is fixedly coupled to the extension member.

In some embodiments, the end effector is powered by an end effector transducer system mounted to the extension member.

In some embodiments, the end effector is powered by an end effector transducer system mounted to the mount.

In some embodiments, the end effector transducer system includes components selected from the group consisting of:

an electric motor;
a capstan transmission;
a belt drive;
a rigid coupling;
a position sensor; and a
brake mechanism.

In some embodiments, the end effector is adapted to receive a tool.

In some embodiments, the tool is selected from the group consisting of:

a laparoscopic tool;
scissors;
a flight control instrument;
a screwdriver;
a syringe;
a hypodermic needle;
a gaming input device;
a handgrip;
a joystick; and
a gimbal mechanism.

Additional aspects and embodiments of the present invention are described below in the context of a detailed description of several example embodiments of the invention.

BRIEF DESCRIPTION OF THE DRAWINGS

Several example embodiments of the present invention will now be described in detail with reference to the drawings, in which.

Similar or corresponding elements in the Figures are identified with similar or corresponding reference numerals.

DETAILED DESCRIPTION OF EXAMPLE EMBODIMENTS

Figure 1:
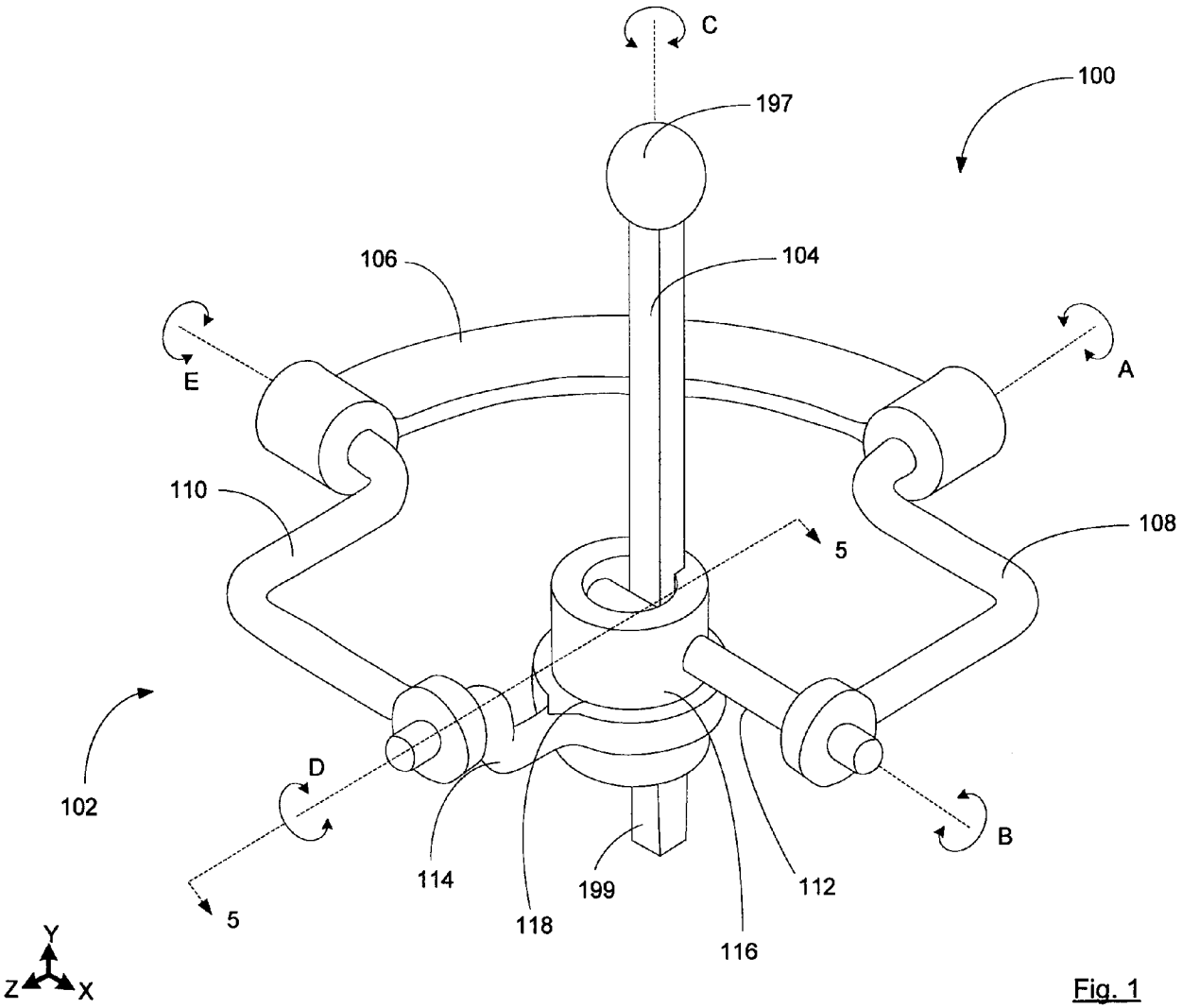
FIG. 1 is a perspective view of a schematic of a first example mechanical linkage.
Figure 5:
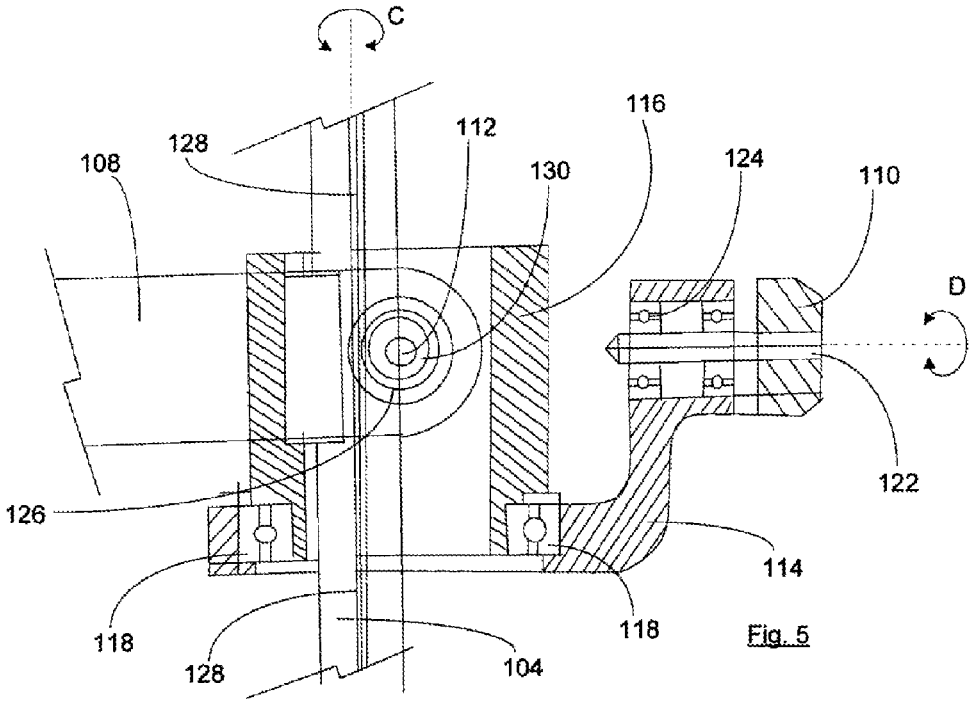
FIG. 5 is an isolated sectional view of a portion of the mechanical linkage of FIG. 1.

Reference is first made to FIGS. 1 and 5. FIG. 1 schematically illustrates a first exemplary embodiment of a mechanical linkage 100. FIG. 5 provides a more detailed isolated sectional view of a portion of the mechanical linkage 100, and in particular the coupling of a linkage 102 to extension member 104. Mechanical linkage 100 comprises the linkage 102, and the extension member 104. The linkage 102 comprises a ground member 106, a first connecting member 108, a second connecting member 110, a first link member 112, a second link member 114, and a mount 116.

At a first end of the first connecting member 108, adjacent to the ground member 106, the first connecting member 108 is rotationally coupled to the ground member 106. The rotational coupling of the first connecting member 108 to the ground member 106 fixes the first connecting member 108 to the ground member 106 but permits rotation of the first connecting member 108 about an axis A, relative the ground member 106. At a second end of the first connecting member 108, adjacent to the first link member 112, the first connecting member 108 is rotationally coupled to a first end of the first link member 112. The first link member 112 is fixed to the first connecting member 108, but can rotate about axis B relative to the first connecting member 108.

At a second end of the first link member 112, adjacent to the mount 116, the first link member 112 is rotationally coupled to the mount 116. The first link member 112 is fixed to the mount 116, but can rotate about axis B relative to the mount 116. The first link member 112 is rotationally coupled at a first end to the first connecting member 108, and at a second end to the mount 116 and thereby rotationally couples the first connecting member 108 to the mount 116.

The mount 116 is also rotationally coupled to the second link member 114 at a first end of the second link member 114. The second link member 114 can rotate about the axis C relative to the mount 116. Axis C is typically substantially parallel to the longitudinal axis of the extension member 104. The rotational coupling of the second link member 114 to the mount 116 may be provided with a rotational bearing 118. As seen in FIG. 5, in this embodiment, rotational bearing 118 substantially encircles the circumference of the mount 116. In another embodiment, the rotational bearing 118 may be nested into the mount 116 or may have another construction.

At a second end of the second link member 114, the second link member 114 is rotationally coupled to a first end of the second connecting member 110. The second link member 114 can rotate about axis D, relative to the second connecting member 110. The second link member 114 rotationally couples the second connecting member 110 to the mount 116.

At a second end of the second connecting member 110, the second connecting member 110 is rotationally coupled to the ground member 106. The second grounded connecting element 110 can rotate about axis E relative to ground member 106.

Reference is now made to FIG. 5. A pin member 122 is fixedly coupled at a first end adjacent to the second connecting member 110, to the second connecting member 110. The pin member 122 is also rotationally coupled at a second end to the second link member 114 via a rotational bearing 124. The rotational bearing 124 is fixed to the second link member 114 and permits the second link member 114 to rotate about axis D relative to the second connecting member 110.

In another embodiment (not shown) the pin member 122 may be fixed to the second link member 114, and coupled to the second connecting member 110 via a rotational bearing 124. In this embodiment, the rotational bearing 124 is fixed to the second connecting member 110.

The extension member 104 is coupled to both the mount 116, and to the first link member 112. The extension member 104 is fixedly coupled to the mount 116 for all degrees of freedom except translation along the C axis. Extension member 104 is described in more detail below.

Linkage 102 is a parallel linkage with one interface point (the extension member 104) that resolves to two grounded points: the couplings between connecting members 108 and 110 and the grounded member 106.

Referring again to FIG. 1, in the present embodiment, axes A and E are essentially orthogonal and intersect one another. In another embodiment, they may not be orthogonal.

A user can physically interact with the extension member 104, typically through a tool, such as a laparoscopic tool, that may be attached to the extension member 104 at an end effector 197.

Referring to FIG. 5, the translation of the extension member 104 along axis C is coupled to the rotational displacement of the first link member 112 by a capstan transmission 126. In other embodiments (not shown) the rotational displacement of the first link member 112 may be coupled to the translation of the extension member 104 along axis C by a rack and pinion mechanism, by a friction drive, or by any other means.

A brief description of one example capstan transmission 126 is provided here for clarity, although other configurations of capstan transmissions, and other transmission means may be used. A first end and a second end of a cable 128 are fixed to the extension member 104 at a first cable anchor location (not shown) and a second cable anchor location (not shown), respectively. Typically, the first cable anchor location is adjacent to the end effector 197 of the extension member 104, and the second cable anchor location is adjacent an extension member tip 199 located at a distance from the first cable anchor location. The cable 128 may be, for example, a thin coated or uncoated metal wire, or it may be plain metal wire, thread, string, or a belt.

The capstan transmission 126 is located adjacent to the first link member 112 and between the first cable anchor location and the second cable anchor location. The capstan transmission 126 converts the rotation of the first link member 112 around axis B into the translation of the extension member 104. The capstan transmission 126 may also convert the translation of the extension member 104 into rotation of the first link member 112 about axis B. As is discussed in more detail below, the rotation of the first link member 112 around axis B is also coupled to a transducer (not shown in FIG. 5). The transducer comprises a position sensor (not shown in FIG. 5) that can monitor the rotation of the first link member 112, and also to an actuator (not shown in FIG. 5) that can power the rotation of the first link member 112 around axis B.

The capstan transmission 126 comprises a capstan 130. The cable 128 is operably coupled to the capstan 130, for example the cable 128 may be wound around the circumference of the capstan 130. The cable 128 may be wound around the capstan 130 a number of times to ensure sufficient frictional interaction and to reduce slipping between the capstan 130 and the cable 128.

In one embodiment, the capstan 130 is fixedly coupled to the first link member 112, such that when the first link member 112 rotates about axis B, the capstan 130 correspondingly rotates about axis B. As the capstan 130 rotates about axis B, the cable 128 is displaced, and the extension member 104 is translated along axis C. The first link member 112 may rotate clockwise or counterclockwise causing the capstan 130 to rotate clockwise or clockwise respectively, resulting in translation of the extension member 104 along axis C in two directions. The reverse situation is also possible. For example, as the extension member 104 translates along axis C, as a result of, for example, a user manipulation, the translating extension member 104 causes displacement of the cable 128, causing rotation of the capstan 130 and the first link member 112.

The linkage 102 in the exemplary embodiment shown in FIGS. 1 and 5 is a six member closed parallel linkage comprised of, as described above, a ground member 106, a first connecting member 108, a first link member 112, a mount 116, a second link member 114, and a second connecting member 110.

Figure 2:
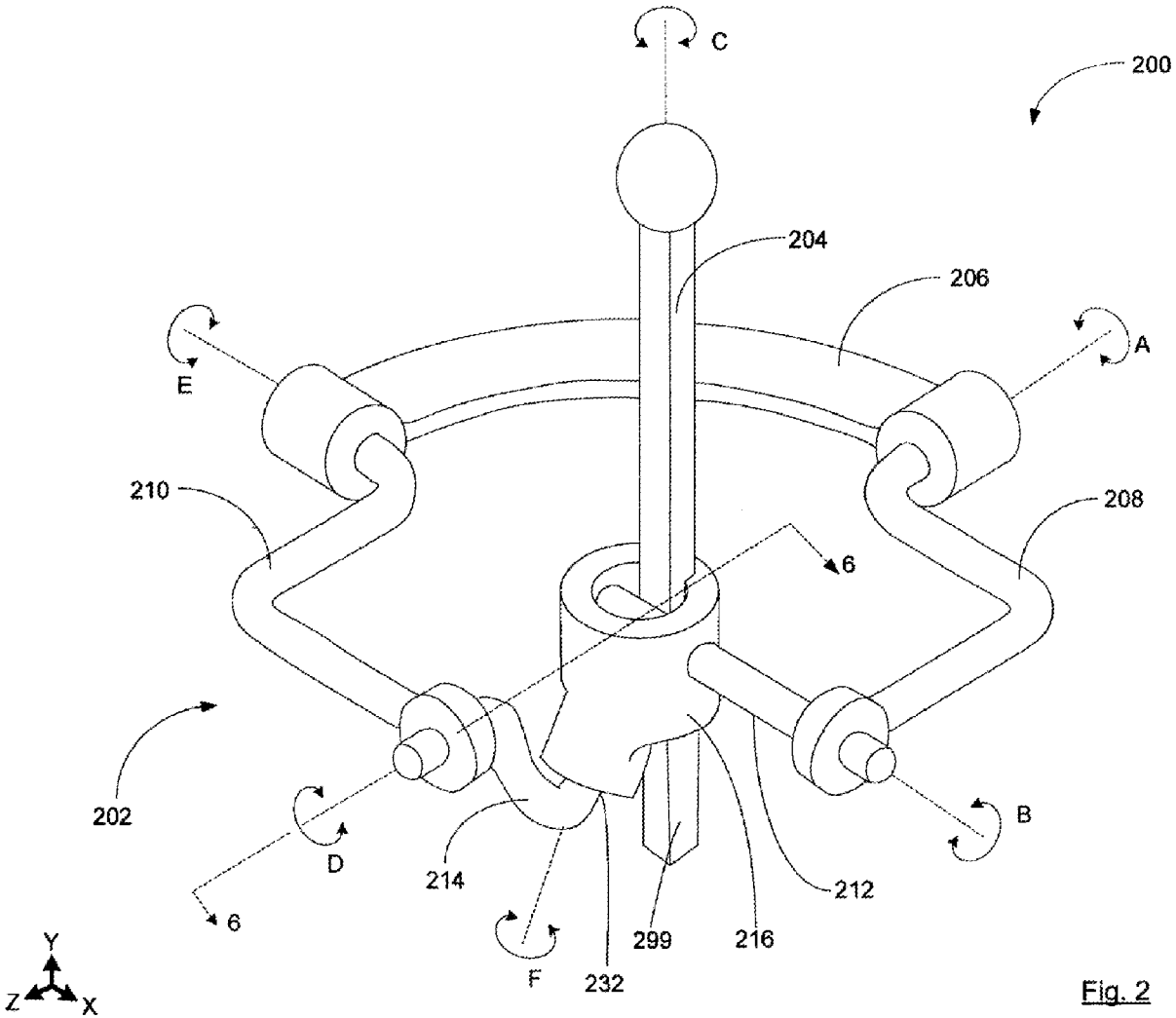
FIG. 2 is a perspective view of a schematic of a second example mechanical linkage.
Figure 6:
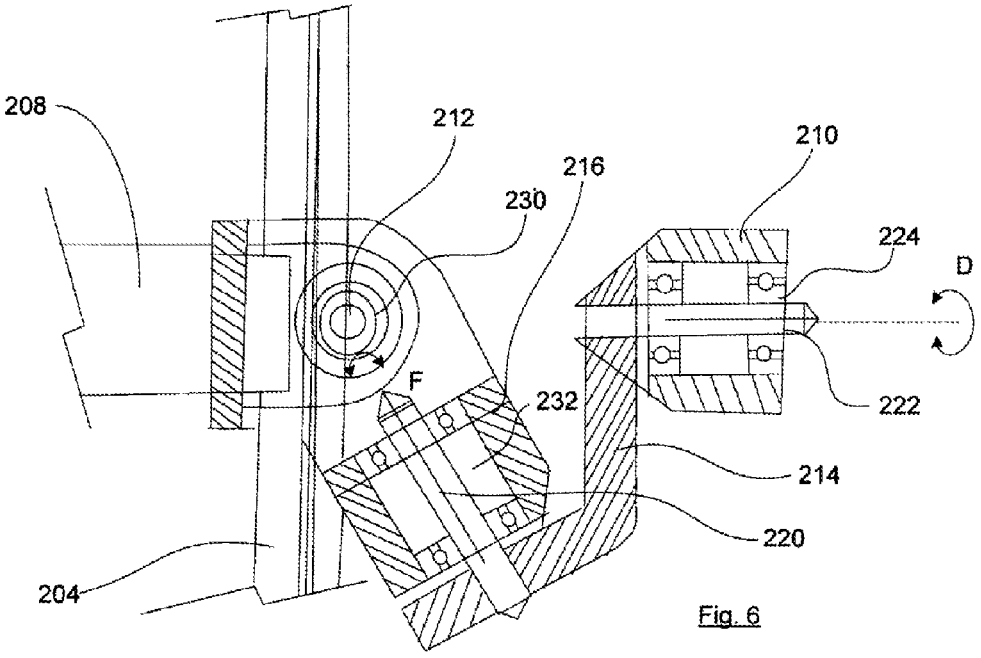
FIG. 6 is an isolated sectional view of a portion of the mechanical linkage of FIG. 2.

Reference is now made to FIGS. 2 and 6. FIG. 2 schematically illustrates a second exemplary embodiment of a mechanical linkage 200. FIG. 6 illustrates a more detailed isolated sectional view of a portion of the mechanical linkage 200. Mechanism 200 is similar to mechanism 100 described above. Similar or analogous parts of mechanism 100 and mechanism 200 are identified with similar reference numerals in FIGS. 2 and 6.

In linkage 102 the extension member 104 passes through the rotational bearing 118. In linkage 202 the extension member 204 does not pass through a rotational bearing, but rather rotational bearing 232 is offset from the mount 216.

Reference is now made to FIG. 6. The linkage 202 is a six member closed linkage comprised of a ground member 206, a first connecting member 208, a first link member 212, a mount 216, a second link member 214, and a second connecting member 210. The linkage 202 is also a closed parallel linkage that provides support for the extension member 204.

In the example linkage 202, a first end of a pin member 220 is fixedly coupled to a first end of the second linking member 214, adjacent to the mount 216. A second end of the pin member 220 is rotationally coupled to the mount 216 via the rotational bearing 232. The second link member 214 can rotate about the axis F relative to the mount 216. The rotational bearing 232 is fixed to the mount 216. An alternate example embodiment (not shown) could include the pin member 220 being fixed to the mount 216, and the rotational bearing being fixed to the second link member 214.

A first end of the second connecting member 210 is rotationally coupled about axis D to a second end of the second link member 214, through a pin member 222 and the rotational bearing 224. The second link member 214 can rotate about axis D relative to the second connecting member 210. As shown, the pin member 222 is fixed to the second link member 214, and is rotationally coupled to the rotational bearing 224, and the rotational bearing 224 is fixed to the first end of the second connecting member 210. As discussed above, the position of the rotational bearing 224, and the pin member 222 may be reversed. For example, the pin member 222 may be fixed to the second connecting member 210, and coupled to the second link member 214 through the rotational bearing 224, where the rotational bearing 224 is fixed to the second link member 214.

The example linkage 202 permits the same overall degrees of freedom to the extension member 204 as was afforded to extension member 104 in the example linkage 102. From the perspective of a user interacting with a tool (not shown) attached to the extension member 204, the mechanical linkage 200 behaves substantially the same as the mechanical linkage 100.

Figure 3:
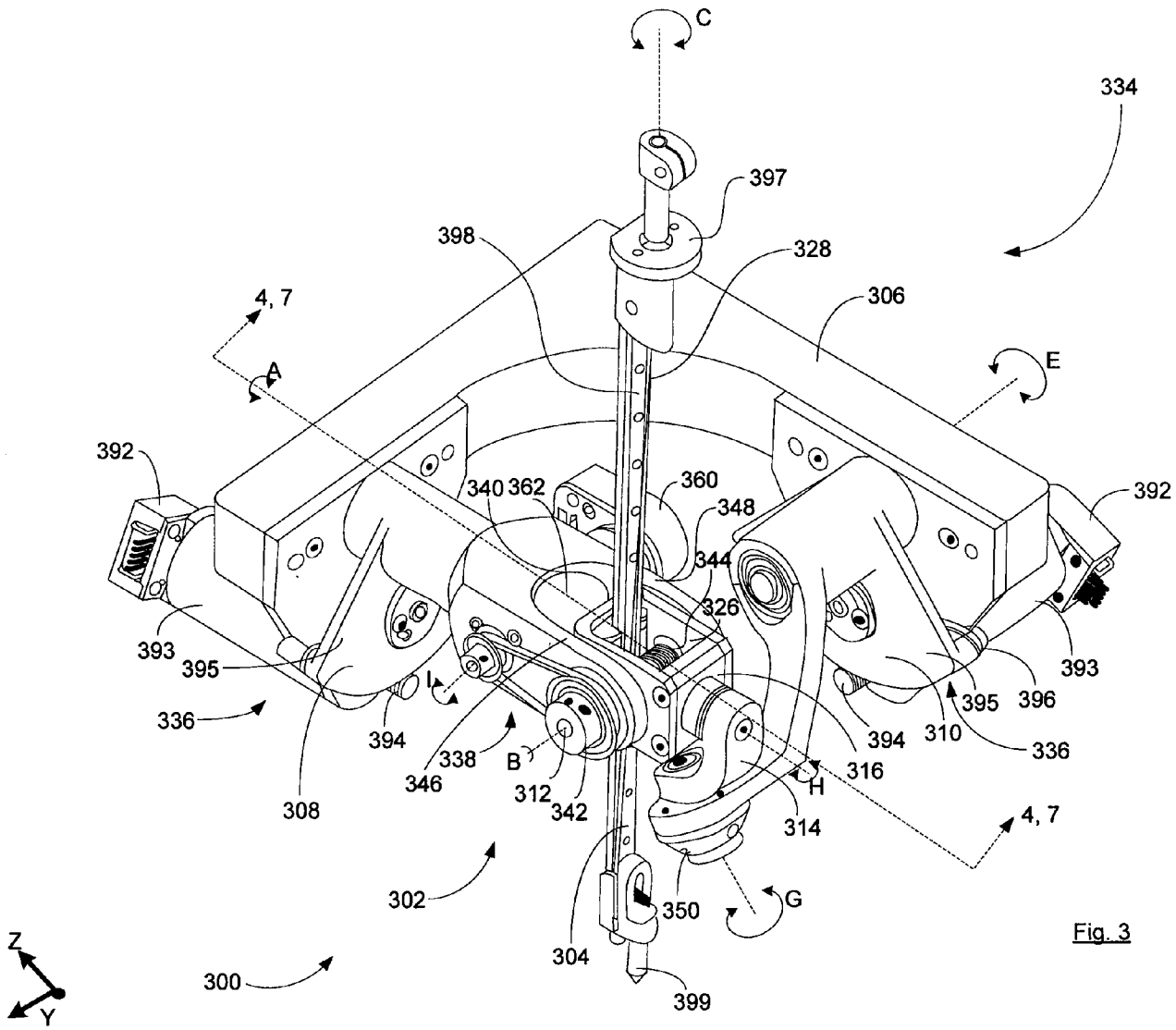
FIG. 3 is a perspective view of another example mechanical linkage.
Figure 4:
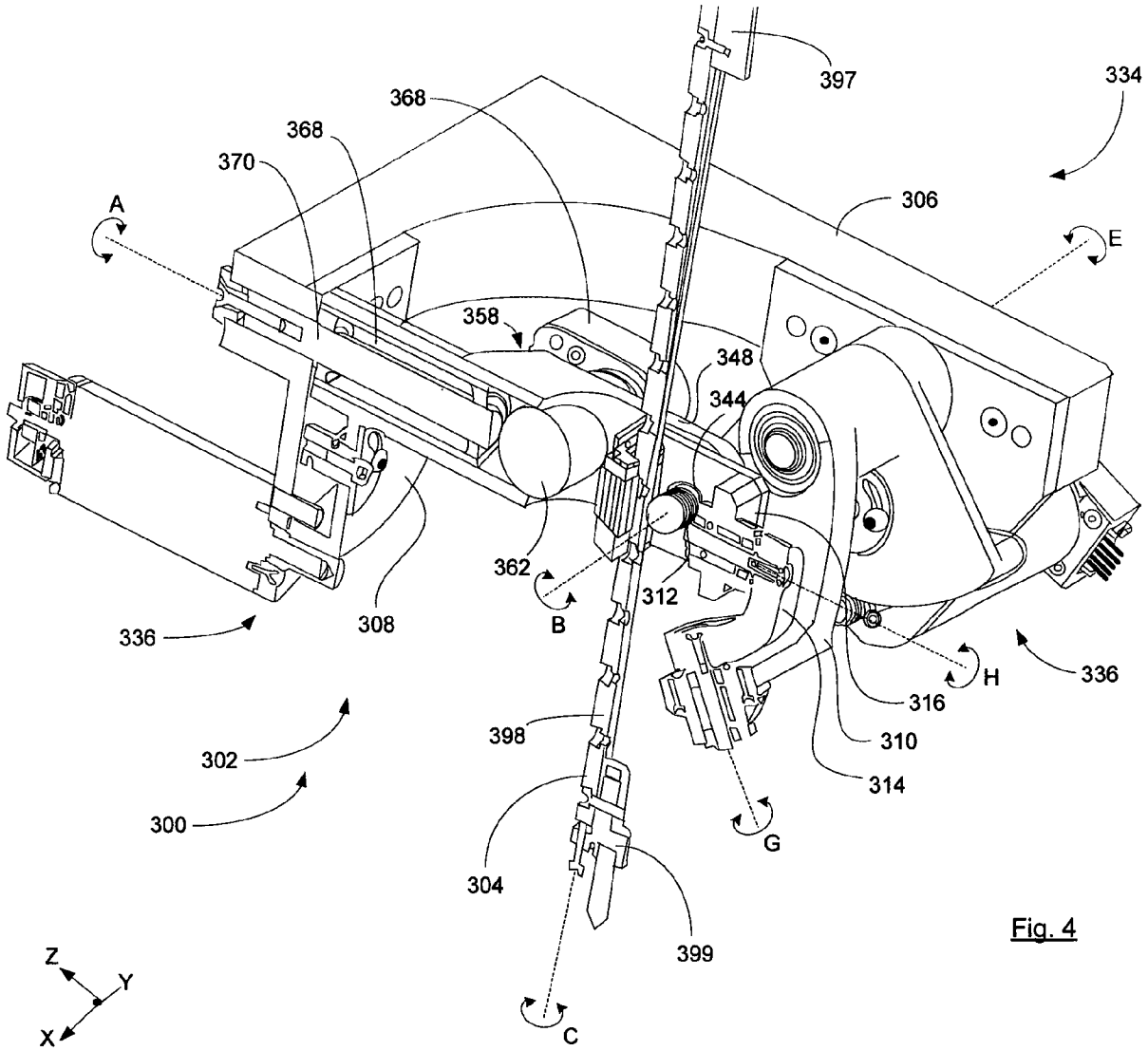
FIG. 4 is a perspective view of a section of the mechanical linkage of FIG. 3.
Figure 7:
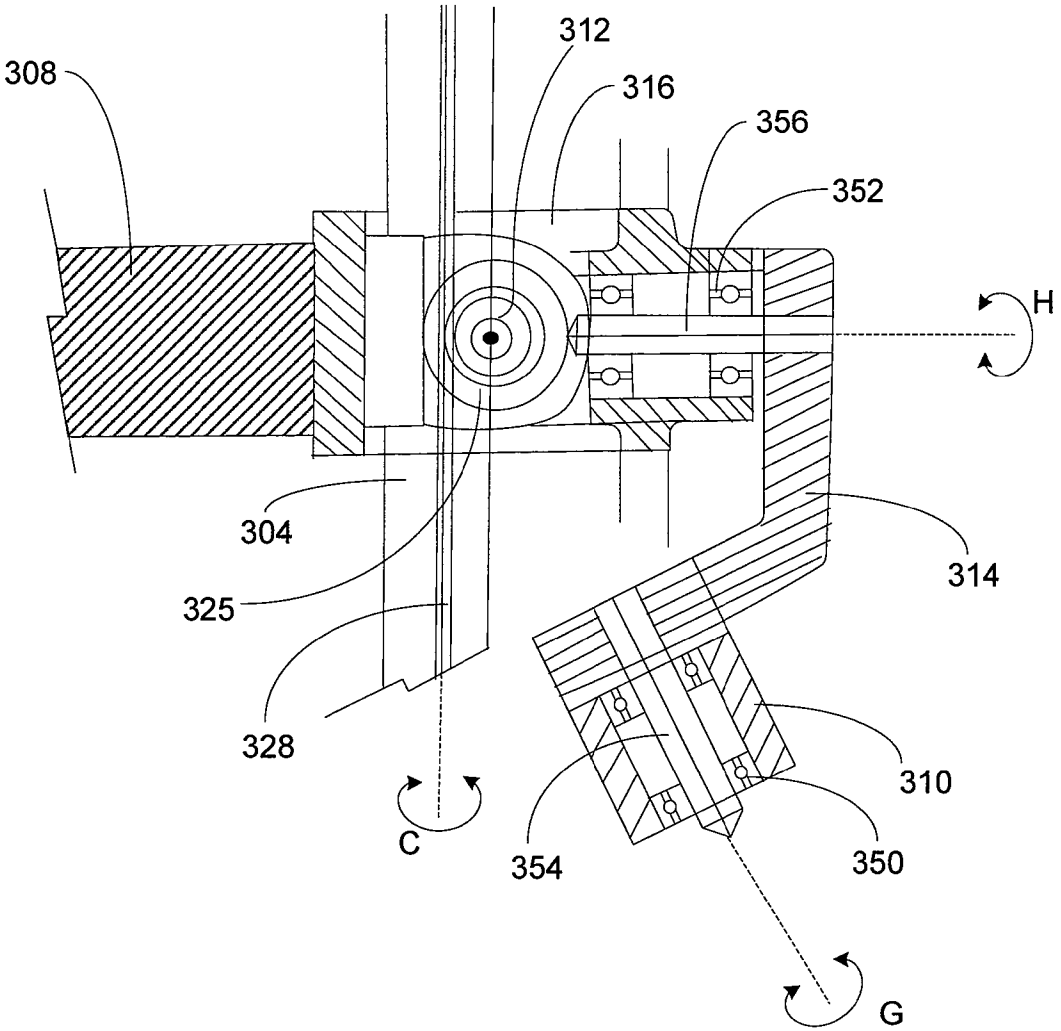
FIG. 7 is an isolated sectional view of a portion of the mechanical linkage of FIG. 3.

Reference is now made to FIGS. 3, 4, and 7. FIG. 3 illustrates another example mechanical linkage 334. FIG. 4 illustrates a section view of the mechanical linkage 334. FIG. 7 illustrates a more detailed isolated sectional view of a portion of the mechanical linkage 334. Mechanical linkage 334 comprises a mechanical linkage 300 that is similar to the mechanisms 100 and 200 described above. Similar or analogous parts of mechanical linkage 334 and mechanism 100 and mechanism 200 are identified with similar reference numerals in FIGS. 3, 4 and 7.

The mechanical linkage 334 comprises a mechanical linkage 300, two grounded connection transducer systems 336, and an extension member transducer system 338. Mechanical linkage 300 comprises a linkage 302, and an extension member 304.

Linkage 302 is a six member closed linkage comprised of a ground member 306, a first connecting member 308, a first link member 312, a mount 316, a second link member 314, and a second connecting member 310. The linkage 302 is also a parallel closed linkage that provides support for the extension member 304. The mechanical linkage 334, or components of the mechanical linkage 334 may be made of any material such as, for example plastic, metal, or wood. In one example, the linkage 302 may be made primarily of aluminum.

At a first end of the first connecting member 308, the connecting member 308 is rotationally coupled to the ground member 306. The first connecting member 308 can rotate about axis A relative to the ground member 306. Typically the rotational coupling of the first connecting member 308 to the ground member 306 is achieved using a rotational coupling (not shown).

At a second end of the first connecting member 308 the first connecting member 308 is rotationally coupled to the first link member 312. The first link member 312 can rotate about the axis B relative to the first connecting member 308. Typically, although not necessarily, the rotational coupling of the first link member 312 to the first connecting member 308 is achieved using a rotational bearing (not shown).

In this example embodiment, the second end of the first connecting member 308, adjacent to the first link member 312, forms a clevis 340 that has a "C" shaped opening having a first arm 346 and a second arm 348. In the illustrated example, both the first arm 346 and the second arm 348 of the clevis 340 of the first connecting member 308 are substantially parallel. In other embodiments, the first arm 346 and the second arm 348 need not be parallel. The clevis 340 of the first connecting member 308 is sized to permit the mount 316 to fit within the opening of the clevis 340. In addition, the clevis 340 opening is dimensioned to not impede the motion or rotation of the mount 316, or the extension member 304 when the mechanical linkage 334 is in use.

The clevis 340 may be shape differently. For example, in another embodiment (not shown) the clevis 340 may have only one arm. In this example, the first link member 312 is rotationally coupled at only one end to the first connecting member 308.

The first link member 312 has a first end 342 and second end 344. Adjacent to the first end 342 of the first link member 312, the first link member 312 is rotationally coupled to the first arm 346 of the clevis 340 of the first connecting member 308. Adjacent to the second end 344 of the first link member 312, the first link member 312 is rotationally coupled to second arm 348 of the clevis 340 of the first connecting member 308. As was stated above, the first link member 312 may rotate about axis B relative to the first connecting member 308. In some embodiments, rotational bearings (not shown) sized to fit the first link member 312 are fixed to both the first arm 346 and the second arm 348 of the clevis 340 of the first connecting member 308. These rotational bearings permit the first link member 312 to be rotationally coupled to the first connecting member 308, as was described above.

In this embodiment, the first link member 312 is also rotationally coupled to the mount 316. In this embodiment, the first link member 312 is rotationally coupled to the mount by bearings not shown to permit the mount to rotate relative to opposing sides of the mount adjacent the first arm 346 and second arm 436 of the first connected grounding member. The mount 316 may rotate relative to the first link member 312 and the first connecting member 308 about axis B.

In another embodiment, the mount 316 may be coupled to the first connecting member 308 rather than to first link member 312. The mount 316 may be rotationally coupled to the first connecting member 308 with a rotational bearing. The first link member may be rotational coupled to the first connecting member and may simply pass through the rotational bearing.

Similar to the discussion above related to the capstan transmission 126, the first link member 312 is also operably coupled via a capstan transmission 326 to the translation of the extension member 304 along the axis C. In other embodiments (not shown) the first link member 312 may be operably coupled to the translation of the extension member 304 via a rack and pinion mechanism, or a friction drive.

As previously discussed for FIGS. 1 and 5, and for FIGS. 2 and 6, there are many possible embodiments for coupling the mount 316 to the second linking member 314. A further example embodiment is described here with reference to FIGS. 3, 4 and 7.

Similar to the example mechanical linkage 200, the extension member 304 of mechanical linkage 300 shown in FIGS. 3, 4 and 7 is offset from the rotational bearing 352.

A first end of a pin member 356 is fixedly coupled to a first end of the second link member 314, adjacent to the mount 316. A second end of the pin member 356 is rotationally coupled to the mount 316 via the rotational bearing 352. The rotational bearing 352 is fixed to the mount 316. The second link member 314 can rotate about the axis H relative to the mount 316. In another example embodiment (not shown) the pin member 356 could be fixed to the second link member 314, with the rotational bearing 352 being fixed to the mount 316.

A first end of the second connecting member 310, is rotationally coupled to a second end of the second link member 314, through a pin member 354 and a rotational bearing 350. The pin member 354 is fixed to the second link member 314, and is rotationally coupled to the rotational bearing 350, where the rotational bearing 350 is fixed to the first end of the second connecting member 310. The second link member 314 can rotate about axis G relative to the second connecting member 310. In another embodiment, the position of the rotational bearing 350, and the pin member 354 may be reversed. For example, the pin member 354 may be fixed to the second connecting member 310, and coupled to the second link member 314 through the rotational bearing 350, where the rotational bearing 350 is fixed to the second link member 314.

The example linkage 302 permits the same overall degrees of freedom to the extension member 304 as was afforded to extension member 104 or 204 in the example linkages 102 or 202 respectively. From the perspective of the user interacting with a tool (not shown) attached to the extension member 304, the mechanical linkage 300 behaves substantially the same as the mechanical linkage 100 or the mechanical linkage 200.

At a second end of the second connecting member 310, the second connecting member 310 is rotationally coupled to the ground member 306. Typically, the second connecting member 310 is coupled to the ground member 306 via a rotational bearing (not shown). The second connecting member 310 can rotate about axis E relative to the ground member 306.

Extension member 304 comprises an end effector 397, a linear portion 398, and an extension member tip 399. If a capstan transmission 326 is used to operably couple the first link member 312 to the translation of the extension member 304 along the C axis, the extension member 304 may also comprise a cable anchor location (not shown). In some embodiments where, for example, a rack and pinion (not shown) or friction drive (not shown) are used to operably couple the first link member 312 to the translation of the extension member 304, the extension member may not comprise a cable anchor location.

The end effector 397 is coupled to a first end of the extension member 304 to allow a user to interact with the extension member 304. The end effector 397 is adapted to allow various interfaces, for example tools, to be coupled to the extension member 304. Some example interface embodiments are described in more detail below.

The extension member tip 399 is attached to a second end of the extension member 304. The second end of the extension member 304 is at the end of the extension member 304 opposite the end effector 397. The end effector 397 at a first end, and the extension member tip 399 at a second end define the longitudinal axis of the extension member 304.

The portion of the extension member 304 located between the end effector 397 and the extension member tip 399 also bounds the linear portion 398 of the extension member 304. The linear portion 398 of the extension member 304 is the portion of the extension member 304 that couples the extension member 304 to the mount 316 of the linkage 302. The linear portion 398 of the extension member 304 is coupled to the mount 316 so as to permit translation of the extension member 304 along the C axis in either direction. The linear portion 398 of the extension member 304 is typically fixed to the mount 316 in all other degrees of freedom. For example, if a user rotates the extension member 304 around the axes A or E, the mount 316 rotates as well.

Figure 18:
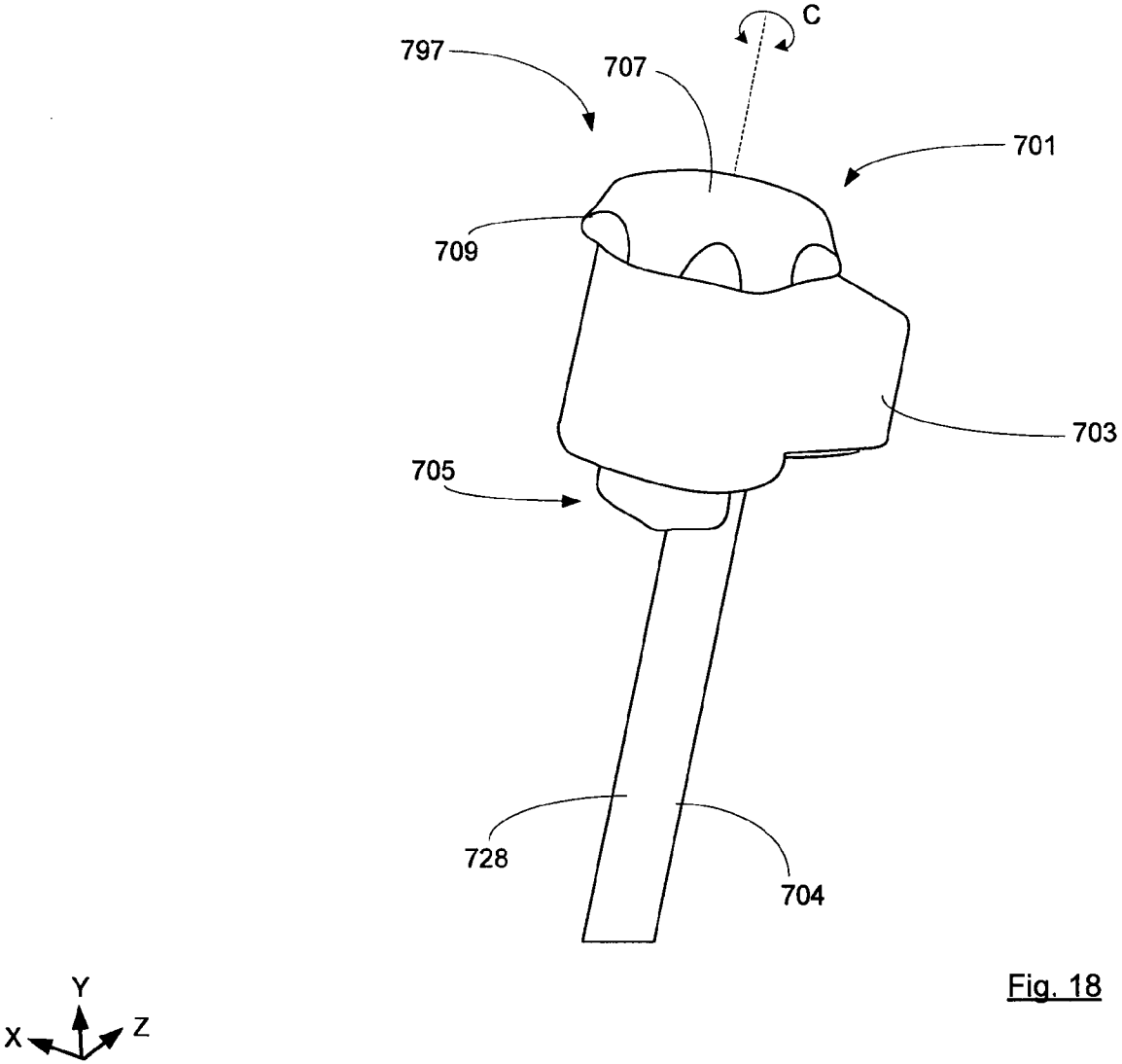
FIG. 18 is an isolated perspective view of a first example end effector.

Reference is now made to FIG. 18. FIG. 18 illustrates an isolated perspective view of a first example end effector 797. In one example, the C axis rotation of the interface may be passively monitored. As mentioned, typically the linear member 704 comprises an end effector 797. The end effector 797 may be coupled to the extension member 704 via any means, such as, for example, an adhesive, or a mechanical locking means such as a bolt and nut or interlocking means.

In some examples, the end effector 797 may comprise an interface coupler 701, a position sensor 703, and a cable anchor location 728. The interface coupler 701 may be any means of coupling an interface (not shown) to the end effector 797. In some examples, the interface coupler 701 comprises a threaded hole 707 that is adapted to couple with a threaded connector of an interface. The threaded connector has threads corresponding to those of the threaded hole 707, allowing the interface to be selectively rotationally mechanically interlocked to the interface coupler 701. In one example, the interface may be rotationally mechanically interlocked to the interface coupler 701 by the user rotating the interface coupler rotating head 709. In other examples, not shown, the interface may be coupled to the end effector 797 via a clamp, a setscrew, a taper-lock, a clip, a friction fit or any other means. Typically, but not necessarily, after the interface is coupled to the interface coupler 701, the interface remains free to rotate about the C axis.

The position sensor 703 is operably linked to the C axis rotation of the interface, such that the position sensor 703 can monitor the position of the interface as it rotates about the C axis. The position sensor 703 may be any type of position sensor and may include an encoder; in one example, the position sensor 701 is a potentiometer. The position sensor 703 may also be operably linked to a control system, similar to the extension member transducer system, and connecting member transducer system. Operably linking the position sensor 703 to the control system may be achieved by a communication link, or any means of communication, including a wired or wireless communication means.

As mentioned above in some embodiments a capstan transmission may be used to couple the extension member 704 to the first link member. If a capstan transmission is used, the end effector 797 may comprise a cable anchor location 705. The cable anchor location 705 is the location where the cable 728 used in the capstan transmission couples to the extension member 704. Typically, there are two cable anchor locations (not shown) on the extension member 704, one adjacent to the end effector 797 of the extension member 704, and the second adjacent the extension member tip (not shown). The cable 728 may be coupled to the extension member by any means, such as for example a friction fit, a mechanical interlock, or a headed anchoring system (the headed anchor system is described in more detail below). Typically, the cable 728 is coupled to the end effector 797 and the extension member tip in similar fashions.

Figure 19:
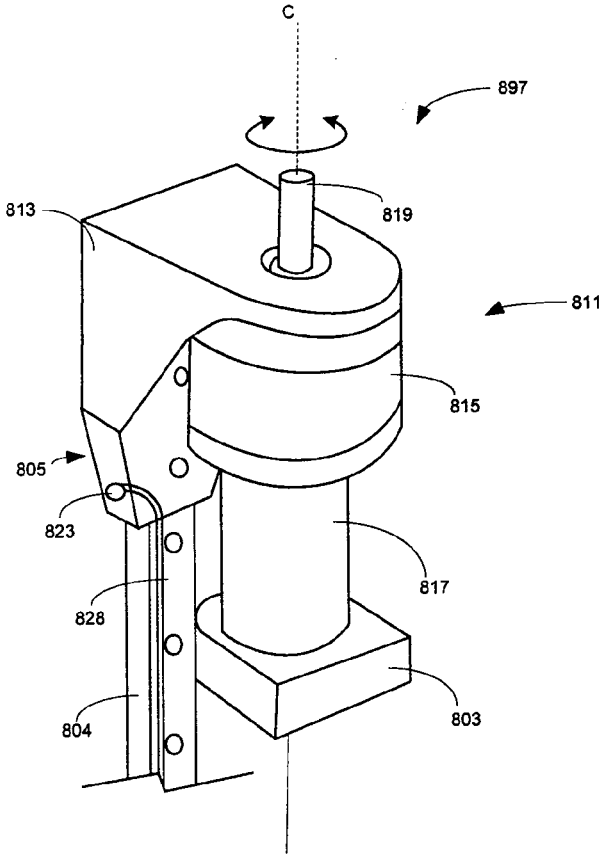
FIG. 19 is an isolated perspective of a second example end effector.
Figure 20:
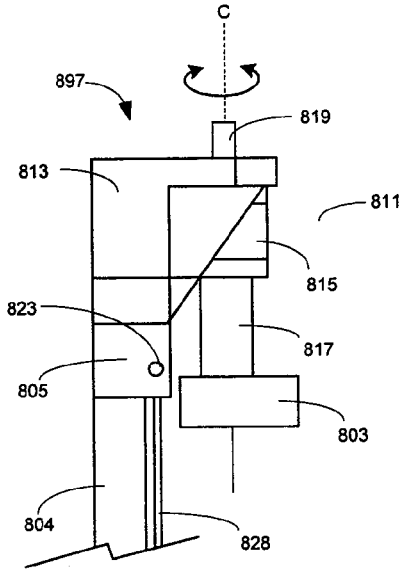
FIG. 20 is a side elevation view of the end effector of FIG. 19.

Reference is now made to FIGS. 19 and 20. FIGS. 19 and 20 illustrate one embodiment of an end effector 897 where the C axis (translation axis) rotation of an interface is powered and monitored. In one example, the end effector 897 comprises an extension member transducer rotation system 811, and an end effector mount 813. In some embodiments the extension member transducer rotation system 811 comprises a gear head 815, an extension member rotation actuator 817, an extension member rotation position sensor 803, and an output shaft 819. In one embodiment the extension member transducer rotation system 811 may not comprise a gear head 815.

The extension member transducer rotation system 811 operates similarly to the connecting member transducer system, and the extension member transducer system, discussed in more detail below. The output shaft 819 is fixedly coupled to an interface so that when the interface rotates about the C axis, the output shaft 819 also rotates about the C axis, or when the interface is displaced, the output shaft 819 and therefore the end effector 897 and the extension member 804 is displaced. Alternatively, if the output shaft 819 is powered, the interface can rotate about the C axis (translation) in response.

The output shaft 819 may be threaded, or otherwise adapted to fixedly couple to the interface. Other coupling means between the output shaft 819 and the interface include, for example, clamping, a setscrew, a taper-lock, a clip a friction fit or the like. The extension member rotation position sensor 803 monitors the position of the rotation of the output shaft 819. The extension member rotation position sensor 803 may be any type of position sensor and may include an encoder; in one example embodiment the extension member rotation position sensor 803 is a potentiometer.

The extension member rotation actuator 817 may be used to power the rotation of the output shaft 819. Typically, an interface is coupled to the output shaft 819, and the rotation of the interface around the C axis is therefore also powered. The extension member rotation actuator 817 may aid or resist the user in rotating the interface around the C axis. If the extension member transducer rotation system 811 comprises a gear head 815, the gear head 819 can be used to adjust the gear ratio between the output shaft 819 and the extension member rotation actuator 817. The gear head 819 may, for example, permit the use of a smaller extension member rotation actuator 817 to achieve the desired torque output on the output shaft 819. In addition, the gear head 819 may permit the extension member rotation position sensor 803 to have better resolution in monitoring the rotation of the output shaft 819.

The end effector mount 813 is typically adapted to substantially fixedly support the extension member transducer rotation system 811 in proper positioning. Typically the axis of rotation of the output shaft 819 of the extension member transducer rotation system 811 is parallel to the C axis. In addition, the end effector mount 813 may also comprise a cable anchor location 805 if the mechanical linkage comprises a capstan coupling the rotation of the first link member to the translation of the extension member 804. In the example of a capstan, the cable 828 used to operably couple the capstan to the translation of the extension member 804 may be anchored to the extension member 804 at a cable anchor location 805 located within the end effector mount 813. In one embodiment, the cable 828 may be anchored at the cable anchor location 805 via an end of the cable 828 protruding through a protrusion in the end effector mount 813 (for example a headed anchoring system). The protruding end of the cable 828 is fused to an enlarged head 823, where the enlarged head 823 is sized to have a diameter larger than the protrusion in the end effector mount 813, thereby anchoring the cable 828 to the end effector mount 813.

Figure 21:
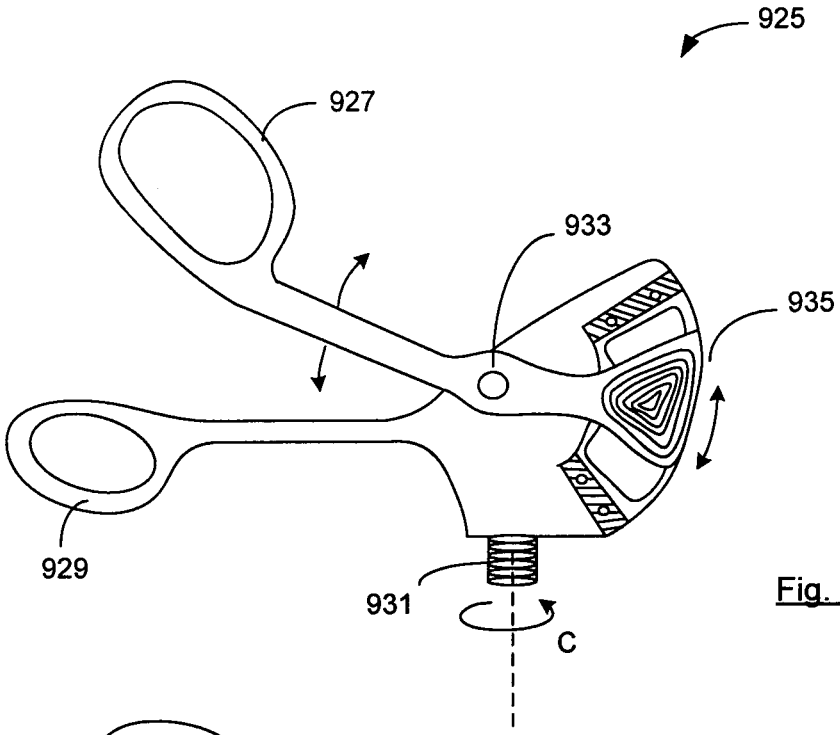
FIG. 21 is a side elevation view of a first example interface.

Reference is now made to FIG. 21, which illustrates an example interface 925. Interface 925 comprises an upper scissor handle 927, a lower scissor handle 929, an end effector connector 931, a position sensor 933, and an actuator 935. In one example, the interface 925 has a rotational degree of freedom that is powered and monitored. The upper and lower scissor handles 927, 929 can simulate any type of scissors, including, for example a laparoscopic scissor tool. The upper and lower scissor handles 927, 929 are adapted to be able to rotate relative to each other around a point of rotation. The point of rotation is monitored by a position sensor 933 that, in one embodiment, is located at the point of rotation of the upper and lower scissor handles 927, 929 relative to each other. The position sensor 933 may include an encoder. The position sensor may be any type of position sensor such as, for example, a potentiometer and may be located elsewhere.

An actuator 935 may also power the rotation of the upper and lower scissor handles 927, 929 relative to each other. In one example embodiment, the actuator 935 may be a voice coil operably coupled to the upper and lower scissor handles 927, 929 is used to power the rotation of the upper and lower scissor handles 927, 929 relative to each other. Current may be introduced into the voice coil in one direction or in the opposite direction to power the rotation of the upper and lower scissor handles 927, 929 relative to each other.

In the case of either the position sensor 933 and the actuator 935 either may be operably linked to a communication link, which may in turn be operably linked to a control system, similar to the connecting member transducer system or the extension member transducer system, discussed below.

In some embodiments, an optional end effector connector 931 is also coupled to the lower scissor handle 929. The end effector connector 931 allows the interface 925 to be mechanically coupled to the end effector. In one example, the end effector connector 931 may comprise a threaded bolt, which corresponds to a threaded receptacle located on the end effector. Thereby, the interface 925 can be screwed into the end effector, coupling the interface 925 to the end effector.

Figure 22:
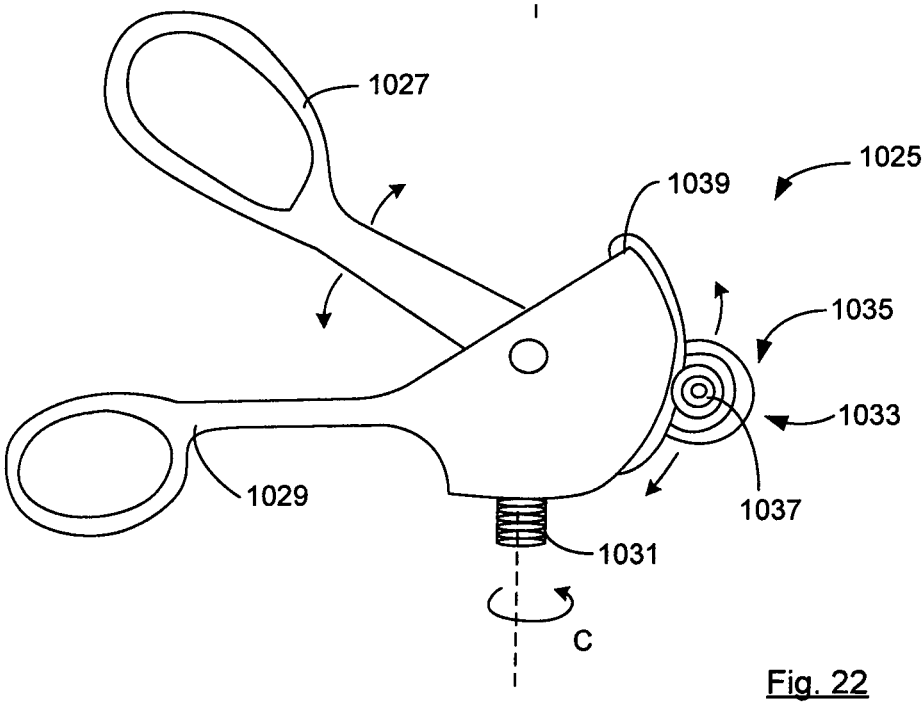
FIG. 22 is a side elevation view of a second example interface.

Reference is now made to FIG. 22, which illustrates a second example interface 1025. The laparoscopic scissor tool simulated by interface 1025 is similar to the laparoscopic scissor tool simulated by interface 925, with the exception that a capstan 1037 and cable 1039 system is used to monitor and power the rotation of the upper and lower scissor handles 1027, 1029. In one embodiment, the cable 1039 is attached at a first end to the upper handles 1027 and the cable 1039 is attached at a second end to the lower scissor handles 1029. At a location between the first and second end of the cable 1039, the cable 1039 is operably coupled to a capstan 1037. The capstan is, in turn, operably coupled to a position sensor 1033, and an actuator 1035. The position sensor 1033 can monitor the rotation of the upper and lower scissor handles 1027, 1029 relative to each other. The actuator 1035 can power the rotation of the upper and lower scissor handles 1027, 1029 relative to each other.

Reference is now made to FIGS. 23A to 23F, which illustrate some further example interface embodiments.

Figure 23C:
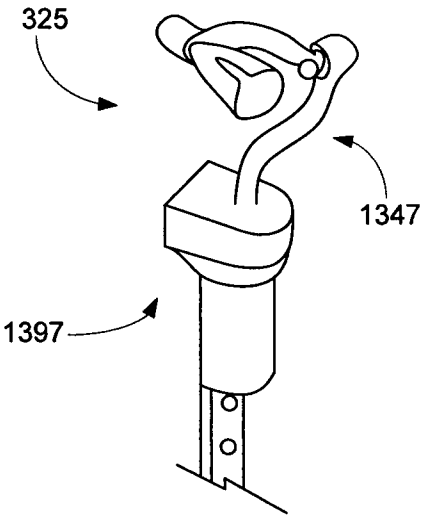
FIG. 23C is an isolated perspective view of a fifth example interface.
Figure 23B:
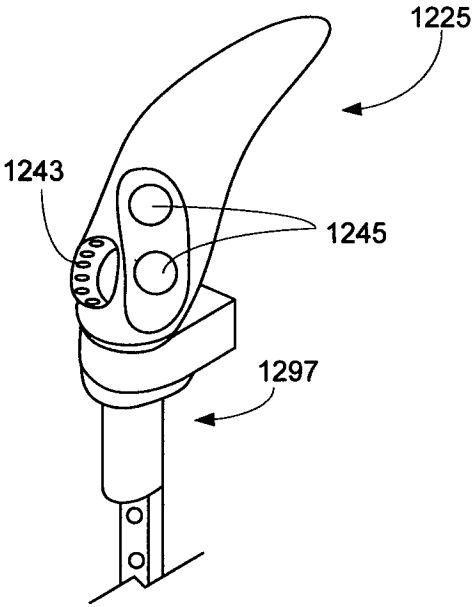
FIG. 23B is an isolated perspective view of a fourth example interface.
Figure 23A:
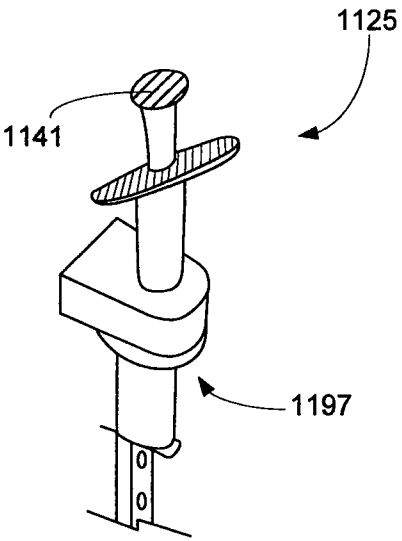
FIG. 23A is an isolated perspective view of a third example interface.

FIG. 23A illustrates a third example interface 1125. The interface 1125 simulates a syringe or a hypodermic needle. In one embodiment the position of the plunger 1141 may be powered and monitored, passively monitored, or neither powered nor monitored.

FIG. 23B illustrates a fourth example interface 1225. The interface 1225 simulates a handle with a finger wheel 1243, and buttons 1245. In one embodiment interface 1225 may be a joystick. In one embodiment the finger wheel 1243, and/or buttons 1245 may be powered and monitored, passively monitored, or neither powered nor monitored.

FIG. 23C illustrates a fifth example interface 1325. The interface, the interface 1325 comprises a gimbal mechanism 1347. The gimbal mechanism 1347 can in turn be used to simulate any type of situation such as, for example, virtual reality. In one embodiment the gimbal mechanism 1347 may be powered and monitored, passively monitored, or neither powered nor monitored in any, or all degrees of freedom.

Figure 23F:
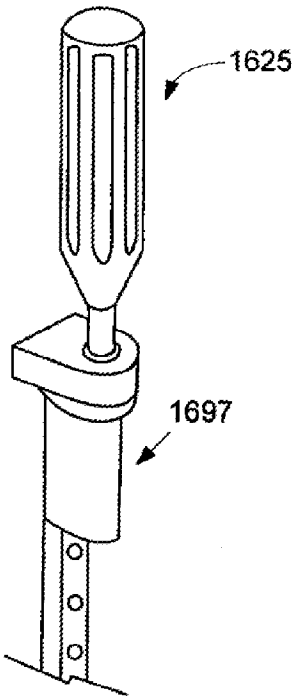
FIG. 23F is an isolated perspective view of an eighth example interface.
Figure 23E:
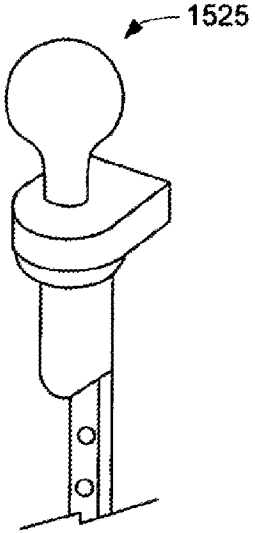
FIG. 23E is an isolated perspective view of a seventh example interface.
Figure 23D:
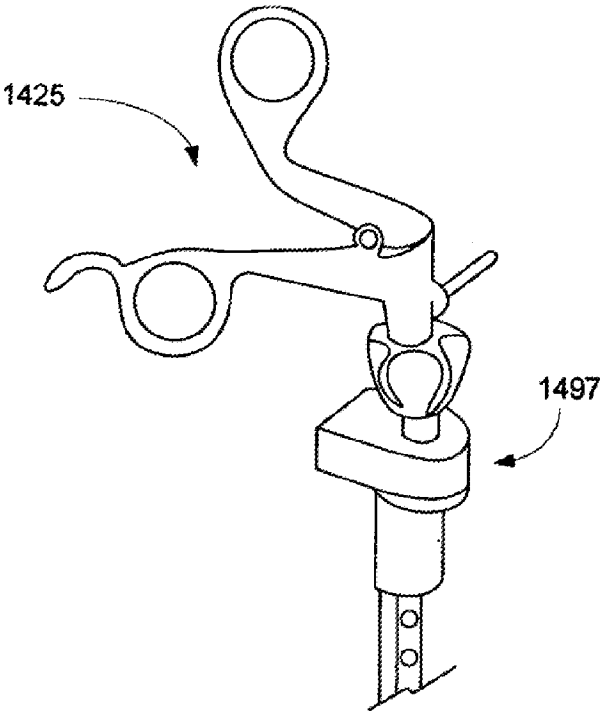
FIG. 23D is an isolated perspective view of a sixth example interface.

FIG. 23D illustrates a sixth example interface 1425. The interface 1425 simulates a laparoscopic scissor. As was discussed in relation to FIGS. 21 and 22, laparoscopic scissor may be powered and monitored, passively monitored, or neither powered nor monitored in any, or all degrees of freedom.

FIG. 23E illustrates a seventh example interface 1525. The interface 1525 simulates a handgrip. In one embodiment the handgrip may be powered and monitored, passively monitored, or neither powered nor monitored.

FIG. 23F illustrates an eighth example interface 1625. The interface 1625 simulates a screwdriver. In one embodiment the screwdriver may be powered and monitored, passively monitored, or neither powered nor monitored.

Reference is now made to FIGS. 8 to 15, which illustrate some exemplary embodiments of a number of extension member transducer systems 338. The various extension member transducer systems illustrated in FIGS. 8 to 15 could be implemented into various mechanical linkages, such as, for example, the mechanical linkage 334 in FIGS. 3 and 4. The mechanical linkage into which the extension member transducer systems 338 is incorporated, such as mechanical linkage 334, could also comprise any linkage, such as, for example, the linkages 102, 202 or 302 shown in FIGS. 1, 2, and 3.

Figure 8:
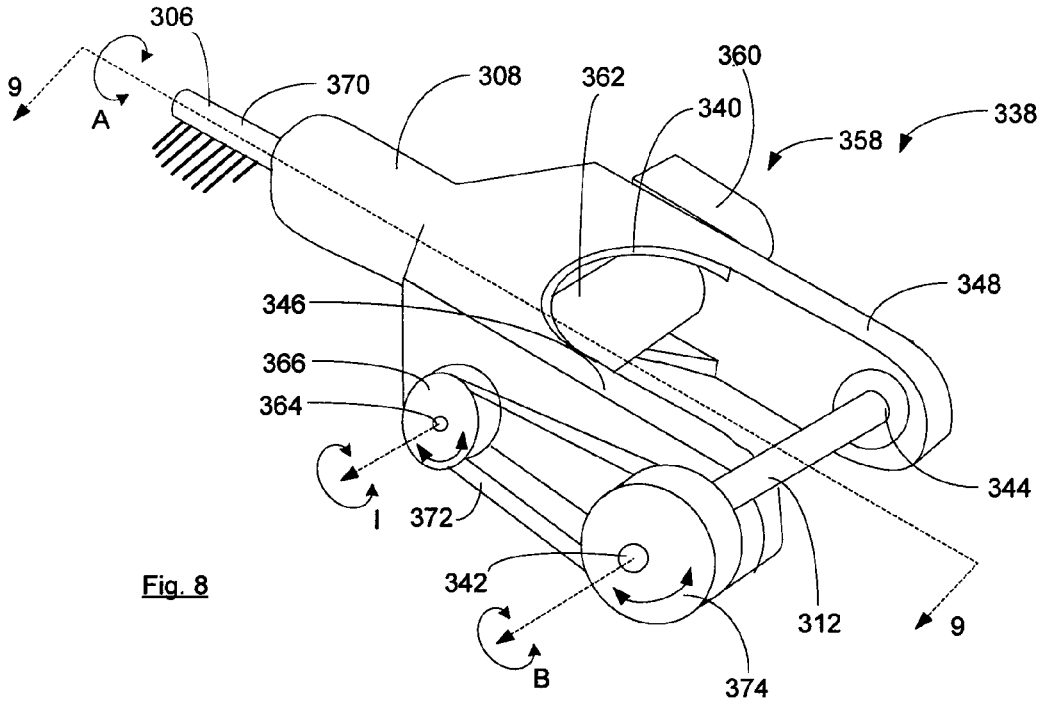
FIG. 8 is an isolated perspective view of a first example extension member transducer system.
Figure 9:
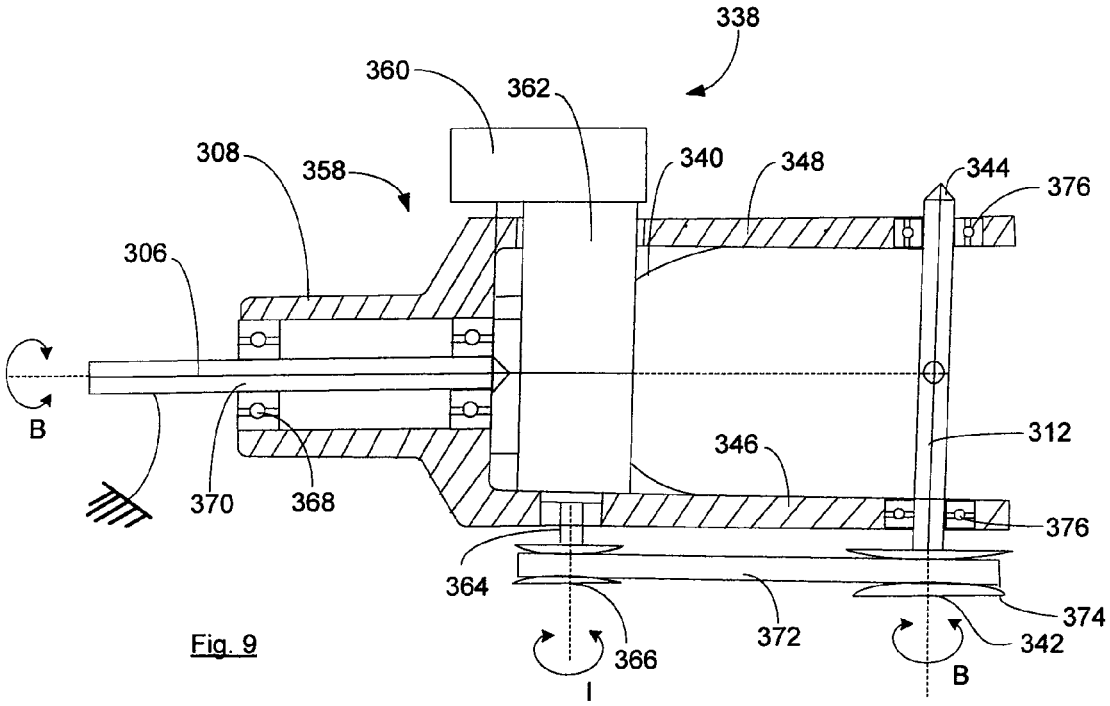
FIG. 9 is a sectional view of the extension member transducer system of FIG. 8.

Reference is now made to FIGS. 8 and 9. FIG. 8 illustrates a perspective view and FIG. 9 illustrates a top sectional view of an extension member transducer system 338. The extension member transducer system 338 includes an extension member transducer 358, an output shaft 364, an output shaft pulley 366, a drive transmission medium 372, and a first link member pulley. As was previously described, the first connecting member 308 is rotationally coupled to the ground member 306, where the first connecting member 308 can rotate about axis A. The rotation of the first connecting member 308 relative to the ground member 306 occurs via the rotational bearing 368. In this embodiment, the rotational bearing 368 is fixed to the first connecting member 308, and the pin member 370, which rotates about axis A within the rotational bearing 368, is fixed to the ground member 306. In another embodiment, the rotational bearing 368 could alternately be fixed to the ground member 306, and the pin member 370 could be fixed to the first connecting member 308.

In this embodiment, an extension member transducer 358 is located in the first connecting member 308, for example the extension member transducer 358 is nested into the first connecting member 308. The extension member transducer 358 has a first end nested into the first arm 346 of the connecting member 308. An output shaft 364 of the extension member transducer 358 extends sufficiently beyond the edge of the first arm 346 of the first connecting member 308 to permit the coupling of an output shaft pulley 366 onto the output shaft 364 of the extension member transducer 358. A second end of the extension member transducer 358 is nested into the second arm 348 of the first connecting member 308.

In addition to the output shaft 364, the extension member transducer 358 typically comprises a position sensor 360 and an actuator 362. In the case of the position sensor 360, the extension member transducer 358 typically operates by converting motion, for example the rotation of the output shaft 364 of the extension member transducer 358, into an electrical signal. In the case of the actuator 362, the transducer typically operates by converting an electrical signal into motion, for example the rotation of the output shaft 364. The actuator 362 typically comprises a motor device, such as, for example an electric motor.

In some example mechanical linkages the extension member transducer 358, comprising the position sensor 360 and the actuator 362 may be operably connected to a control device such as, for example, a computer (not shown). The computer may monitor the output of the position sensor 360, and also control the rotational output of the actuator 362. The computer may be programmed with a system of instructions stored in the computer's memory to intelligently control the monitoring and operation of the extension member transducer 358. In this fashion, a user, such as a medical professional can use a control device, such as a computer, to automatically control the mechanical linkage 334 shown in FIGS. 3 and 4 to simulate a desired virtual reality or a training situation, such as, for example, the behavior of a laparoscopic tool.

As previously mentioned, the extension member transducer 358 includes an output shaft 364, which is rotationally fixed, in this embodiment, to an output shaft pulley 366. The output shaft 364, which is monitored by position sensor 360 and actuated by actuator 362, and the output shaft pulley 366 rotate about an axis I. The output shaft pulley 366, in turn, is coupled to a transmission system that is operably linked to the first link member 312. In this example, the output shaft pulley 366 is coupled to a drive transmission medium 372, which in turn is coupled to a first link member pulley 374. The first link member pulley 374 is rotationally fixed to the first link member 312, such that rotation of the first link member pulley 374 causes rotation of the first link member 312. The drive transmission medium 372 may be, for example a belt, made of, for example, rubber. Other possible example drive transmission medium 372 includes steel belts, wires, string, or chains (in which case the output shaft pulley 366, and the first link member pulley 374 would be appropriately sized and shaped cogs or gears).

As has been discussed, the first link member 312 and the first link member pulley 374 may rotate about an axis B. The rotational bearings 376 are the interface between the first arm 346 and the second arm 348 of the first connecting member 308 and the first end 342 and second end 344 of the first link member 312, respectively. The rotational bearings 376 permit the first link member 312 to rotate about axis B relative to the first connecting member 308.

In other example embodiments, the output shaft pulley 366 and the first link member pulley 374 may be coupled to the drive transmission medium 372 in different ways. A few possible examples include friction, gearing or mechanical interlock (where the pulley may have teeth sized to fix into corresponding grooves in the drive transmission medium 372, or vice versa where the drive transmission medium 372 has teeth and the pulley has corresponding grooves).

The radii of the output shaft pulley 366 and/or the first link member pulley 374 may be increased or decreased to adjust the gear ratio of the operable coupling between the extension member transducer 358 and the first link member 312. Adjusting the radii of the output shaft pulley 366 and/or the first link member pulley 374 can therefore also permit adjustment of the torque transferred from the output shaft 364 of the extension member transducer 358 to the first link member 312, or vice versa. In addition, adjusting the gear ratio may also permit adjustment of the resolution of the rotation of the output shaft 364 monitored by the position sensor 360.

The coupling of the extension member 304 to the extension member transducer system 338 is not shown in FIGS. 8 and 9. However, as was previously described in relation to mechanical linkage 300, a capstan transmission 326 may be used to operably couple the rotation of the first linking member 312 to the translation of the extension member 304. Other examples that may be used to operably link the rotation of the first linking member 312 to the translation of the extension member 304 may include a friction drive, a rack and pinion or any other means.

As described above, the first link member 312 rotates in response to the translation of the extension member 304. The drive transmission 372, in turn, transfers the rotation of the first link member 312 to the extension member transducer 358. The extension member transducer 358 is therefore operably linked to the translation of the extension member 304, and therefore the extension member transducer 358 can control the translation of the extension member 304. For example, the translation of the extension member 304 can be monitored by position sensor 360, and powered by actuator 362.

Figure 10:
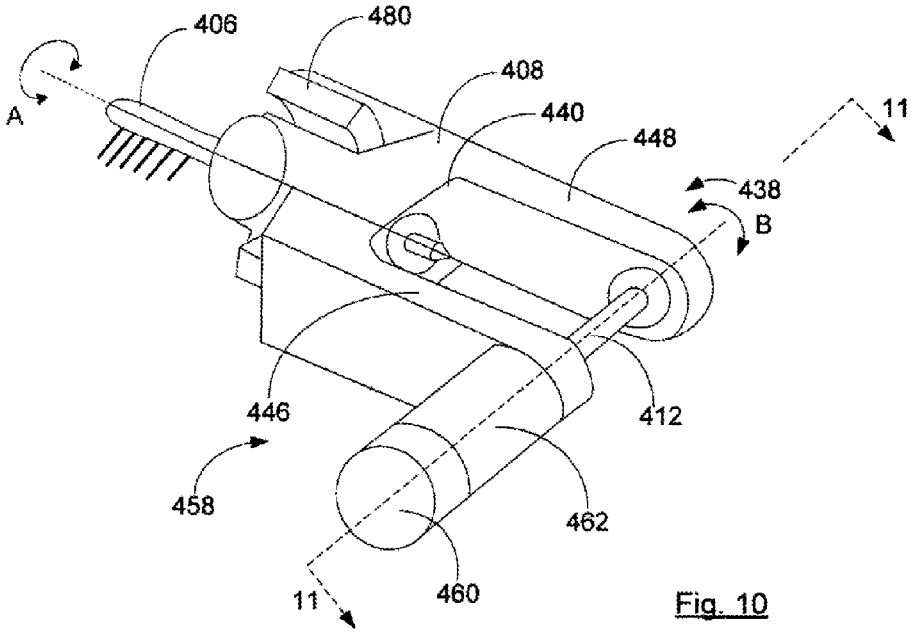
FIG. 10 is an isolated perspective view of a second example extension member transducer system.
Figure 11:
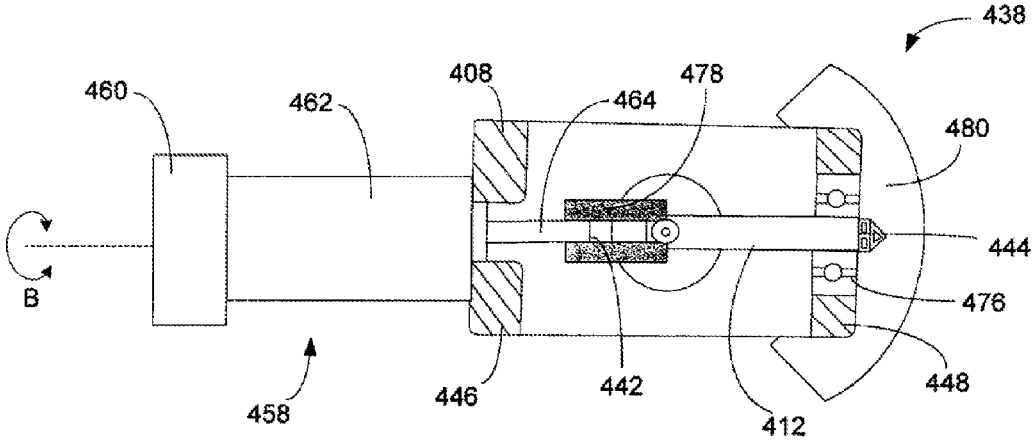
FIG. 11 is a sectional view of the example extension member transducer system of FIG. 10.

Reference is now made to FIGS. 10 and 11, which show another embodiment of an extension member transducer system 438. Similar to the extension member transducer system 338, in the extension member transducer system 438, the first connecting member 408 comprises a clevis 440 at one end. The first connecting member 408 is also rotationally coupled about axis A to the ground member 406 in a similar fashion to the extension member transducer system 338.

Extension member transducer system 438 illustrates an example of a direct drive coupling between the extension member transducer 458 and the first link member 412. Extension member transducer 458 comprises an output shaft 464, a position sensor 460 and an actuator 462. The extension member transducer 458 is coupled to only the first arm 446 of the first connecting member 408. In this example embodiment, the output shaft 464 of the extension member transducer 458 may be directly in-line with the first link member 412. The output shaft 464 may be directly operably coupled to the first end 442 of the first link member 412 through a coupler 478. In one example, the first link member 412, as well as the output shaft 464, rotate substantially about an axis B. The rotation of output shaft 464 therefore occurs substantially in-sync with the rotation of first link member 412. The coupler 478 may be a rigid coupler such as, for example the use of a setscrew, a boring interface (through which the first link member 412, and the output shaft 464 thread directly into each other), or a clamping mechanism. The coupler 478 may also be a flexible coupler permitting the output shaft 464 and the first link member 412 to have some misalignment along the B axis, yet remain operably coupled. The second end 444 of the first link member 412 passes through a rotational bearing 476 which permits the first link member to rotate about axis B relative to the second arm 448 of the first connecting member 408.

As has been previously discussed, a capstan transmission 426 (not shown) is typically used to operably couple the rotation of the first link member 412 to the translational motion of an extension member 404 (not shown). Other examples that may be used to operably link the rotation of the first linking member 412 to the translation of the extension member 404 may include a friction drive, a rack and pinion or by any other means.

The coupling of the extension member transducer 458 to the first arm 446 of the first connecting member 408 may create an eccentricity, or an unbalanced rotational load around axis A on the first connecting member 408. In one embodiment, a counter weight 480 may be coupled to the first connecting member 408. In another embodiment the counter weight 480 may be coupled to the second arm 448 of the first connecting member 408. The counter weight 480 is coupled to first connecting member 408 in order to reduce or eliminate the eccentricity, or to balance the rotational load around axis A of the first connecting member 408.

Figure 12:
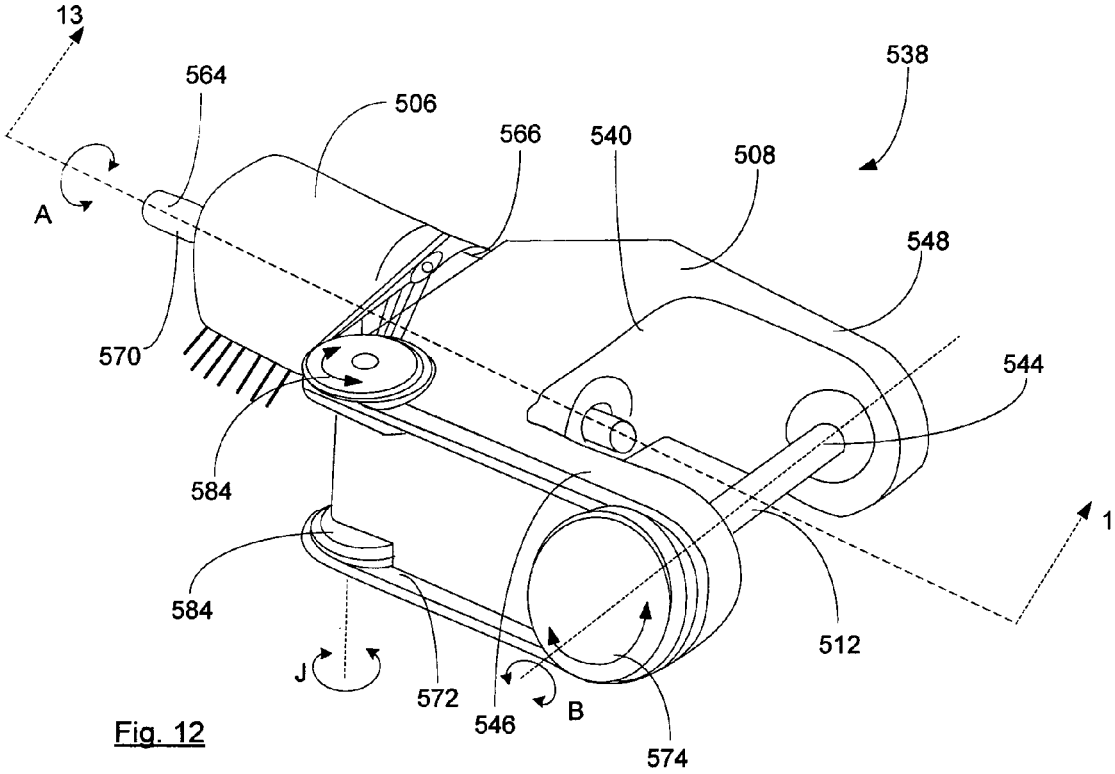
FIG. 12 is an isolated perspective view of a third example extension member transducer system.
Figure 13:
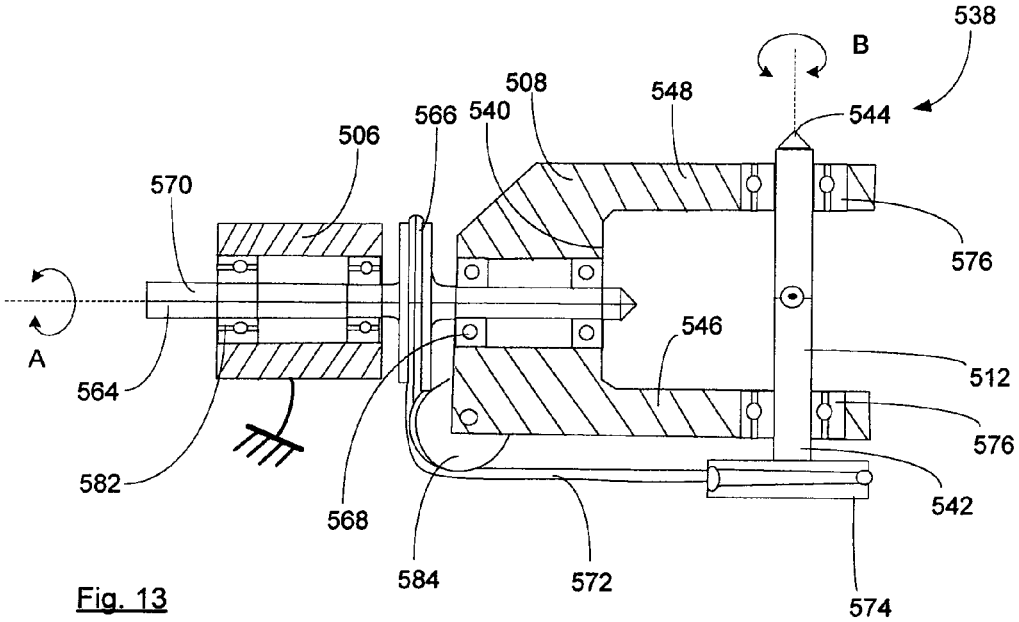
FIG. 13 is a sectional view of the example extension member transducer system of FIG. 12.

Reference is now made to FIGS. 12 and 13, which show an additional exemplary embodiment of an extension member transducer system 538. Extension member transducer system 538 includes a first connecting member 508, a first link member 512, a ground member 506, and an extension member transducer 558 directly coupled to the ground member 506. The first connecting member 508 has a clevis 540. The first link member 512 is rotationally coupled at a first end 542 and at a second end 544 to a first arm 546 and a second arm 548 of the first connecting member 508, respectively. The rotational coupling of the first link member 512 to the first connecting member 508 is typically achieved via rotational bearings 576, permitting the first link member 512 to rotate about the B axis. In addition, a first link member pulley 574 is fixed to the first link member 512 adjacent to a first end 542. Therefore the first link member pulley 574, and the first link member 512 rotate about axis B substantially in synchronicity.

The first connecting member 508 is rotationally coupled to the ground member 506 via pin member 570 and rotational bearing 568. The first connecting member 508 can rotate about axis A relative to the grounded member 506. The pin member 570 also serves as an output shaft 564 of an extension member transducer 558 (not shown). The extension member transducer 558 comprises, in addition to the output shaft 564, a position sensor 560 (not shown) and an actuator 562 (not shown). The pin member 570/output shaft 564 is rotationally coupled to the ground member 506 via rotational bearing 582. Pin member 570/output shaft 564 can therefore rotate about axis A relative to both the ground member 506 and the first connecting member 508.

The pin member 570/output shaft 564 is fixedly coupled to the output shaft pulley 566. In this embodiment, the output shaft pulley 566 is fixed to the pin member 570/output shaft 564 at a location adjacent to both the ground member 506 and the first connecting member 508 (for example at a location between the ground member 506 and the first connecting member 508). In other embodiments the output shaft pulley 566 could be located in other places, for example within the clevis 540 of the first connecting member 508.

Operably coupled to the output shaft pulley 566 is a drive transmission medium 572. As discussed above, the drive transmission medium 572 can be made of different media. For example, in the present exemplary embodiment, the drive transmission medium 572 may be a coated wire. The drive transmission medium 572 is also operably coupled to the first link member pulley 574. The drive transmission medium 572 therefore operably couples the output shaft 564/pin member 570 to the first link member 512.

Similar to the description above, the first link member 512 is operably coupled to the translation of the extension member 504 (not shown), and therefore the output shaft 564/pin member 570 is operably coupled to translation of the extension member 504. The operable coupling of the extension member 504 to the first link member 512 may be through, for example, a capstan transmission 526 (not shown), a friction drive, a rack and pinion or by any other means. Similar to the previous embodiments, the output shaft pulley 566 and the first link member pulley 574 may be operably coupled to the drive transmission medium 572 by a number of means, for example friction or a gearing interlock.

As shown the output shaft 564 rotates about axis A, and the first link member 512 rotates about axis B, and they are operably linked by the drive transmission medium 572. Axis A and axis B are typically substantially orthogonal. The result is that the extension member transducer system 538 also comprises two orthogonal transmission pulleys 584, which permit the drive transmission medium 572 to change direction by a substantially orthogonal angle to couple between the output shaft 564 and the first link member 512.

The orthogonal transmission pulleys 584 are independently rotationally coupled to the first arm 546 side of the first connecting member 508. The orthogonal transmission pulleys 584 rotate about axis J, where axis J is orthogonal to the plane formed by axis A and axis B. As the drive transmission medium 572 displaces, the two orthogonal transmission pulleys 584 rotate in opposite directions, for example as one orthogonal transmission pulley 584 rotates clockwise, the other rotates counter-clockwise. The orthogonal transmission pulleys 584 permit a lower friction, substantially orthogonal, angle change of the drive transmission medium 572.

The present embodiment, extension member transducer system 538 permits the extension member transducer 558 that is operably coupled to and controlling the translation of the extension member 504 to be grounded (i.e. the extension member transducer 558 is coupled directly to the ground member 506), reducing the inertia of a linkage 502. The radii of the output shaft pulley 566 and the first link member pulley 574 can also be changed to alter the gear ratio, and therefore the torque transmission between the output shaft 564 and the first link member 512.

Figure 14:
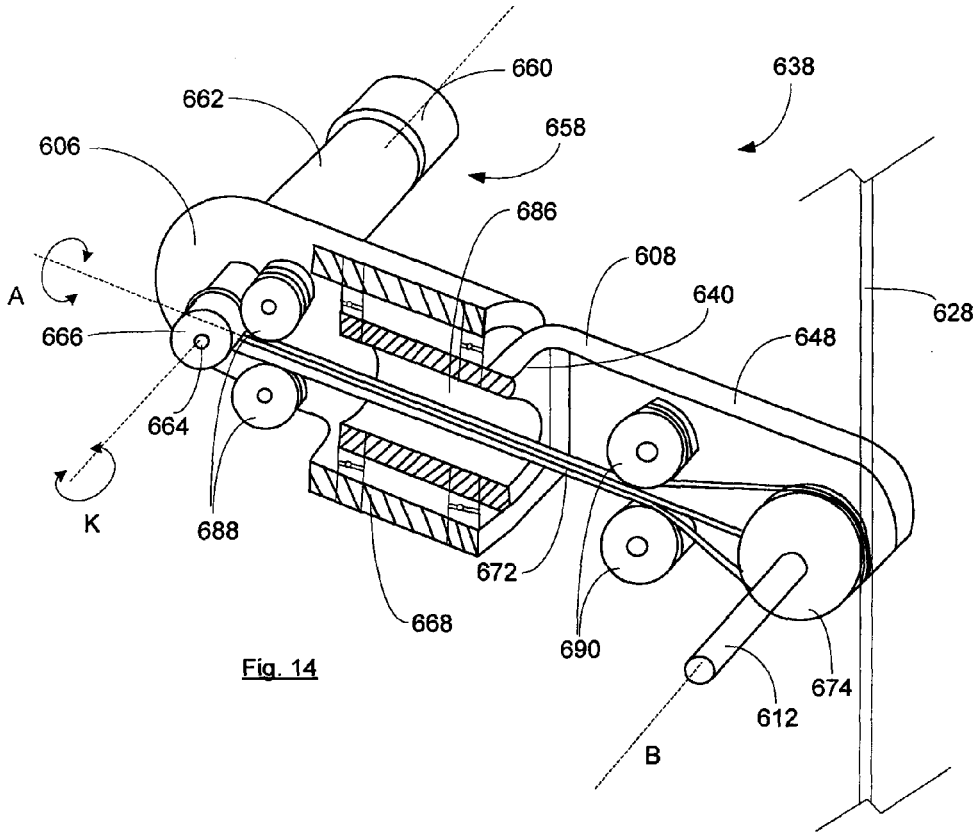
FIG. 14 is an isolated perspective view of a section of the extension member transducer system of FIG. 14A.
Figure 15:
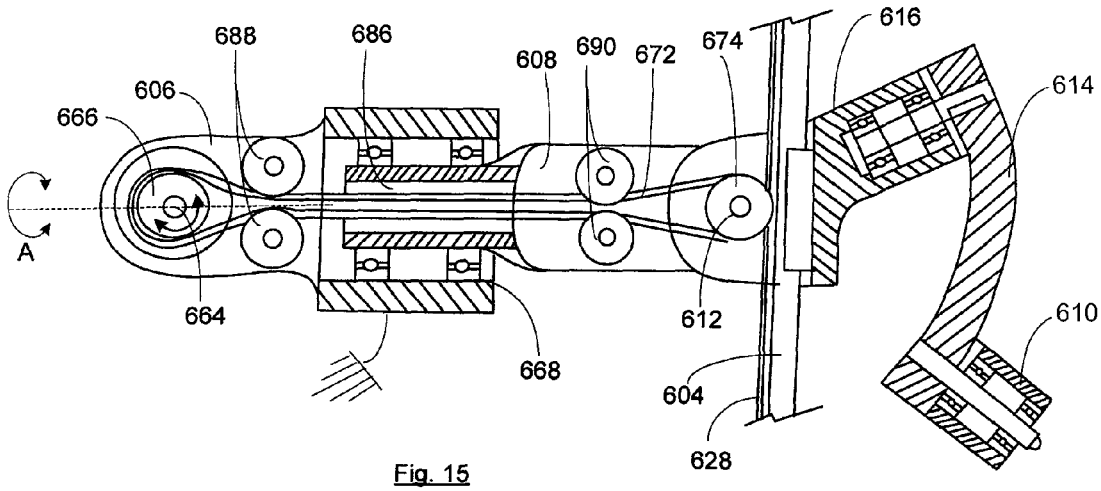
FIG. 15 is an isolated sectional view of the extension member transducer system of FIG. 14A.
Figure 14A:
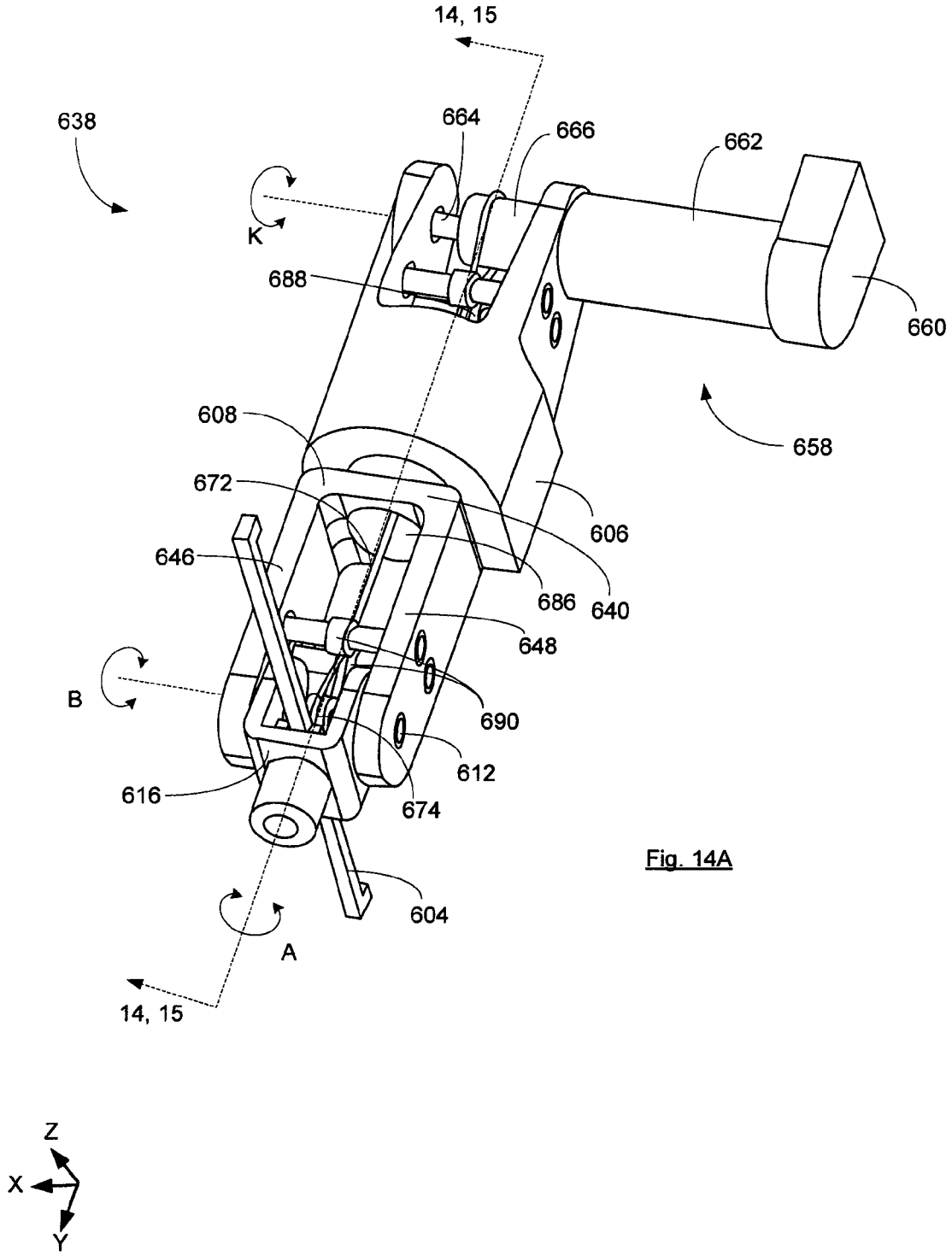
FIG. 14A is an isolated perspective view of a fourth example extension member transducer system.

Reference is now made to FIGS. 14A, 14 and 15, which illustrate one embodiment of an extension member transducer system 638. Extension member transducer system 638 includes a first connecting member 608, a first link member 612, a ground member 606, and an extension member transducer 658 directly coupled to the ground member 606. Similar to extension member transducer system 338, the first connecting member 608 is rotationally coupled to ground member 606. The rotational bearing 668 permits the first connecting member 608 to rotate about axis A relative to the grounded member 606. Adjacent to the rotational bearing 668, the first connecting member 608 also comprises a hollow core 686, which provides a passageway through the length of the first connecting member 608.

As stated, in this embodiment, the extension member transducer 658 is coupled directly to the ground member 606. The extension member transducer 658 comprises an output shaft 664, a position sensor 660 and an actuator 662. An output shaft pulley 666 is typically fixedly coupled to the output shaft 664. The output shaft 664, and the output shaft pulley 666 rotate about axis K, where axis K is typically substantially orthogonal to axis A. The output shaft pulley 666 is operably coupled to a drive transmission medium 672. In one example, the drive transmission medium 672 is a cable, in other examples the drive transmission medium 672 may be a belt or a wire or the like.

Two grounded directional transmission pulleys 688 are typically located adjacent to the output shaft pulley 666. The grounded directional transmissions pulleys 688 are typically rotationally coupled to the ground member 606, and typically rotate about an axis parallel to the axis K. The grounded directional transmission pulleys 688 typically help guide the drive transmission medium 672, providing a proper profile for the drive transmission medium 672 as the drive transmission medium 672 passes through the length of the hollow core 686 of the first connecting member 608. In addition, the grounded directional transmission pulleys 688 provide proper alignment of the drive transmission medium 672 as the drive transmission medium 672 operably couples with the output shaft pulley 666.

The first connecting member 608 also typically comprises two first connecting member transmission pulleys 690. Typically, the first connecting member transmission pulleys 690 together with the grounded directional transmissions pulleys 688 help guide the drive transmission medium 672 between the output shaft pulley 666 and the first link member pulley 674, in particular providing a proper profile for the drive transmission medium 672 as the drive transmission medium 672 passes through the length of the hollow core 686 of the first connecting member 608. In addition, the first connecting member transmission pulleys 690 provide proper alignment of the drive transmission medium 672 as the drive transmission medium 672 operably couples with the first link member pulley 674. Where the first link member pulley 674 is fixedly coupled to the first link member 612.

Typically, the path of the drive transmission medium 672 between the output shaft pulley 666 and the first link member pulley 674 is proximate to the A axis. The rotation of the first connecting member 608 about the A axis therefore does not have a significant effect on the alignment, or tension in the drive transmission medium 672 as it passes between the output shaft pulley 666 and the first link member pulley 674.

Similar to extension member transducer systems 338 and 538, the extension member transducer 658 is, through the system of pulleys and drive transmission medium 672 described above, operably coupled to the first link member 612. In addition, as described above in other example embodiments, the first link member 612 is operably coupled to the translation of the extension member 604 (not shown). The operable coupling of the extension member 604 to the first link member 612 may be through any means, for example, a capstan transmission 626 (not shown) or through a friction drive, a rack and pinion and or by any other means.

In other embodiments, the first link member pulley 674 can be rotationally coupled to the first link member 612 via a rotational bearing (not shown) so that the first link member pulley 674 can rotate about the axis B while the first link member 612 remains static. In this embodiment, the extension member 604 is operably coupled directly to the first link member pulley 674 such that the first link member pulley 674 rotates in response to a translation of the extension member 604 along the C axis (translational axis). The operable coupling of the extension member 604 to the first link member pulley 674 may be through any means, for example, a capstan transmission 626 (not shown), a friction drive, a rack and pinion and or by any other means. In addition in this embodiment, the extension member transducer 658, which is operably coupled to the first link member pulley 674 via the drive transmission medium 672, as discussed above, is therefore operably coupled to the extension member 604. The translation of the extension member 604 can therefore be controlled by the extension member transducer 658, for example the translation of the extension member 604 can be monitored by position sensor 660, and powered by actuator 662.

Similar to the extension member transducer system 538, the present example embodiment of extension member transducer system 638 permits the extension member transducer 658 coupled to the translation of the extension member 604 to remain grounded (i.e. directly coupled to the ground member 606) reducing the inertia of a linkage 602. Also, as discussed above, the radii of the output shaft pulley 664 and/or the first link member pulley 674 can be changed to alter the gear ratio and therefore the torque transmission between the output shaft 664 and the first link member 612.

Figure 16:
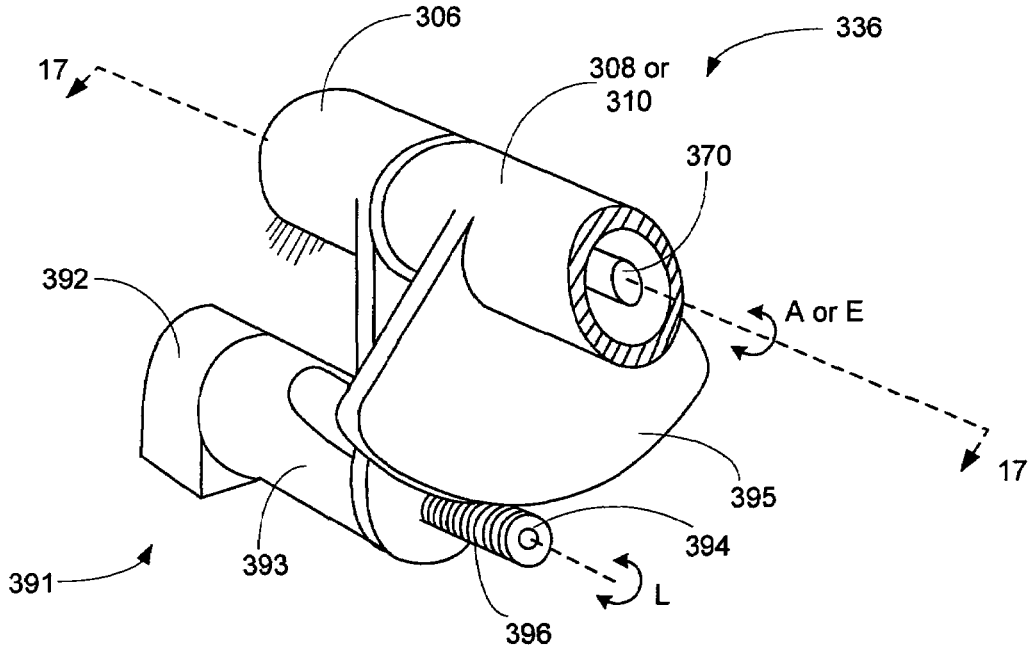
FIG. 16 is an isolated perspective view of an example connecting member transducer system from FIG. 3.
Figure 17:
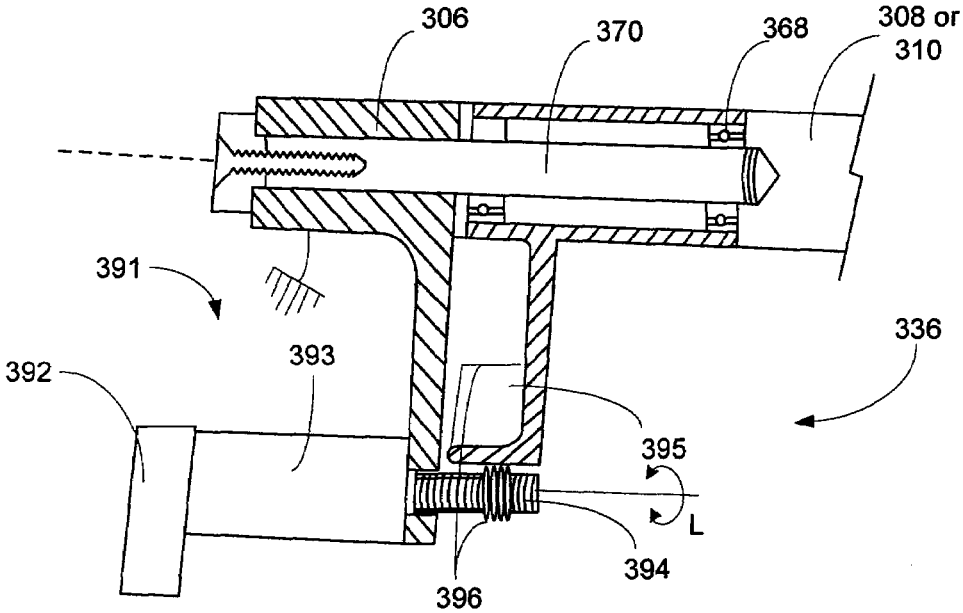
FIG. 17 is an isolated sectional view of the connecting member transducer system from FIG. 16.

Reference is now made to FIGS. 16 and 17, which illustrate an example grounded connection transducer system 336. The grounded connection transducer system 336 illustrated in FIGS. 16 and 17 is one example embodiment for coupling the first connecting member 308 or the second connecting member 310 to the ground member 306.

The grounded connection transducer system 336 comprises a first connecting member 308, or a second connecting member 310, a ground member 306, a grounded connection transducer 391, a connection capstan 394, a connection drum 395, and a connection cable 396. The first or second connecting member 308 or 310 is rotationally coupled to the ground member 306 through rotational bearing 368. The first or second connecting member 308 or 310 can therefore rotate about axis A or E, respectively.

The first or second connecting member 308 or 310 is typically fixedly coupled to the connection drum 395. The connection drum 395 is in turn, operably coupled to the connection capstan 394 by the connection cable 396. The connection cable 396 is fixedly attached (not shown) to the connection drum 395. As the connection capstan 394 rotates about axis L, the connection cable 396 is displaced. Axis L is typically substantially parallel to the axis A or E, as appropriate. The rotation of the connection capstan 394 displaces the connection cable 396 causing the connection drum 395 to rotate, in turn causing the first or second connecting member 308 or 310 to rotate about axes A or E, as is appropriate. Similarly, as the first or second connecting member 308 or 310 rotates about axes A or E because of a user manipulation, the capstan 396 is also forced to rotate about axis L.

The grounded connection transducer 391 is comprised of a grounded connection transducer output shaft (not shown), a grounded connection position sensor 392, and a grounded connection actuator 393. The grounded connection transducer 391 operates similarly to the extension member transducer 358 described above for the extension member transducer systems 338, 438, 538 and 638. The connection capstan 394 is directly and fixedly coupled to the grounded connection transducer output shaft. The connection capstan 394 typically slides over the output shaft of the transducer 391.

The use of a connection capstan 394, a connection drum 395, and a connection cable 396 with the first or second grounded connection members 308, 310, as described, can permit adjustment of the gear ratio between the rotation of the connection capstan 394 and the rotation of the first or second connecting member 308 or 310. Adjustment of the gear ratio may permit an increase or decrease in the torque transferred between the grounded connection actuator 393 and the first or second grounded connection members 308, 310. In addition, the adjusted gear ratio may increase or decrease the resolution of the rotation of the output shaft of the grounded connection actuator 393 monitored by the grounded connection position sensor 392.

The grounded connection transducer 391 may also be operably connected to a control device such as, for example, a computer (not shown). The computer may monitor the output of the grounded connection position sensor 392, and also control the output of the grounded connection actuator 393. The computer may be programmed with a system of instructions stored in the computer's memory to intelligently control the monitoring and operation of the grounded connection transducer 391 and therefore the rotation of the first or second connecting member 308 or 310 around the axes A or E, as appropriate.

Reference is now made again to FIG. 3 in order to provide an outline of the operation of the mechanical linkage 334. A user typically couples an interface (not shown), such as a scissor interface 925, to the end effector 397 of the extension member 304. The interface gives the user a means through which to physically interact with the mechanical linkage 334. Where the mechanical linkage 334 forms part of a haptic system (discussed below), the user's interaction with the mechanical linkage gives the user a means to interact with an environment simulated by the haptic system.

Specifically, in interacting with the interface, the user interacts with the extension member 304. Through the user manipulation of the interface, the extension member 304 causes the mechanical linkage 334 to rotate about any of axes A, E, or C. The rotation of the mechanical linkage about axes A and E is monitored and powered through a connecting member transducer system 336. The connecting member transducer system 336 includes a position sensor 392 and an actuator 393. The user manipulation of the interface may also causes the extension member 304 to translate along the axis C (translation axis). The translation of the extension member 304 is monitored and powered through an extension member transducer system 338. The extension member transducer system 338 includes an extension member transducer 358, which in turn includes a position sensor 360 and an actuator 362.

Rotation of the interface about the C axis is neither monitored nor powered in this example embodiment. In other embodiments, rotation of the interface about the C axis may be monitored and powered, passively monitored, powered but not monitored, or not monitored and not powered. The extension member rotation position sensor (not shown) 803 can, in some embodiments monitor the rotation about the C axis. The extension member rotation actuator (not shown) 817 can, in some embodiments power the rotation of the axis. Together, the extension member rotation position sensor and the extension member rotation actuator are part of the extension member transducer rotation system (not shown) 811.

The term "powered" means that the rotation or translation, as applicable, may be assisted or resisted by a transducer comprising an actuator.

In some embodiments, a haptic system comprises a mechanical linkage 334 and a control system (not shown). The control system is discussed briefly here, and was discussed in more depth above. In some examples the control system may be a computing device adapted to monitor and control the above-mentioned rotations and translations of the extension member 304 of the mechanical linkage 334. The control system may intelligently monitor and power the rotations and translations of the extension member 304 in order to simulate a desired environment for the user, such as, for example, a laparoscopic training session, or a pilot training session, etc.

While what has been shown and described herein constitutes a small number of exemplary embodiments of the subject invention and while some variations of the embodiment have also been described, it should be understood that various modifications and adaptations of such embodiments can be made without departing from the present invention, the scope of which is defined in the appended claims.

We claim:

1. A mechanical linkage comprising:

a ground member;

a first connecting member rotationally coupled to the ground member;

a second connecting member rotationally coupled to the ground member;

an extension member;

a mount adapted for receiving the extension member, wherein the extension member can translate along a longitudinal axis;

a first link member rotationally coupled to the first connecting member; and a second link member for rotationally coupling the second connecting member to the mount, wherein the first link member is coupled to the extension member such that the first link member rotates in response to a translation of the extension member.

2. The mechanical linkage of claim 1 wherein the first link member is powered and wherein the extension member moves along the longitudinal axis in response to a rotation of the first link member.

3. The mechanical linkage of claim 2 wherein the first link member and the extension member are coupled with a linkage selected from the group consisting of:

a capstan transmission;

a rack and pinion mechanism; and a friction drive.

4. The linkage of claim 1 wherein the second link member and the mount are rotationally coupled.

5. The linkage of claim 1 wherein the second link member and the mount are coupled with a rotational coupling.

6. The linkage of claim 5 wherein the extension member passes through the rotational coupling.

7. The linkage of claim 1 wherein the second link member and the mount are rotationally coupled with a bearing that essentially surrounds the mount.

8. The linkage of claim 1 wherein the second link member and the mount are rotationally coupled with a bearing that is at least partially nested within the mount.

9. The mechanical linkage of claim 1 wherein the second link member and the mount are coupled with a second link coupling that is offset from the mount.

10. The mechanical linkage of claim 9 wherein the second connecting member rotates about a second grounded axis and wherein the second link coupling rotates about a second link axis at an angle to the second grounded axis.

11. The mechanical linkage of claim 9 wherein the first connecting member rotates about a first grounded axis and wherein the second link member rotates about the first grounded axis.

12. The mechanical linkage of claim 1 further including an end effector mounted to the extension member, wherein the end effector is adapted to receive a tool.

13. The mechanical linkage of claim 12 wherein the tool corresponds to a member of the group consisting of:

a laparoscopic tool;

scissors;

a flight control instrument;

a screwdriver;

a syringe;

a hypodermic needle;

a gaming input device;

a handgrip;

a joystick; and a gimbal mechanism.

14. The mechanical linkage of claim 12 wherein the tool can rotate about the longitudinal axis and wherein the linkage further comprises an extension member rotation position sensor for monitoring the rotation of the tool.

15. The mechanical linkage of claim 14 further comprising an extension member rotation actuator for controlling the rotation of the tool about the longitudinal axis.

16. The mechanical linkage of claim 1 further comprising an extension member transducer system for controlling the translational position of the extension member along the longitudinal axis.

17. The mechanical linkage of claim 16 wherein the extension member transducer system includes an extension member transducer coupled to the first link member.

18. The mechanical linkage of claim 17 wherein the extension member transducer is directly coupled to the ground member.

19. The mechanical linkage of claim 18 wherein the extension member transducer includes an output shaft and wherein the axis of rotation of the output shaft is substantially orthogonal to the axis of rotation of the first link member.

20. The mechanical linkage of claim 17 wherein the extension member transducer is coupled to the first link member through a coupling selected from the group consisting of:

a belt drive mechanism;

a cable drive mechanism;

a direct drive mechanism;

a friction drive mechanism; and a rack and pinion mechanism.

21. The mechanical linkage of claim 17 wherein the extension member transducer is positioned at least partially within the first connecting member.

* * * * *